US012799687B2

(12) United States Patent
Farr

(10) Patent No.: US 12,799,687 B2
(45) Date of Patent: Nov. 17, 2026

(54) SLIPFORM PAVER CONTROL

(71) Applicant: GOMACO Corporation, Ida Grove, IA (US)

(72) Inventor: Thomas C Farr, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 1184 days.

(21) Appl. No.: 17/846,719

(22) Filed: Jun. 22, 2022

(65) Prior Publication Data

US 2025/0382754 A1 Dec. 18, 2025

Related U.S. Application Data

(60) Provisional application No. 63/231,961, filed on Aug. 11, 2021.

(51) Int. Cl.
*E01C 19/48* (2006.01)

(52) U.S. Cl.
CPC ..... *E01C 19/4893* (2013.01)

(58) Field of Classification Search
CPC ..... E01C 19/4893; E01C 19/4873; E01C 19/4853; E01C 19/48; E01C 2301/00
See application file for complete search history.

(56) References Cited

U.S. PATENT DOCUMENTS 6,481,924 B1 * 11/2002 Smolders ..... E01C 19/42 180/408
6,692,185 B2 * 2/2004 Colvard ..... B62D 11/20 180/9.5
6,890,123 B2 * 5/2005 Piccoli ..... E01C 19/4893 404/101
7,284,472 B1 10/2007 Soellner et al.
9,051,696 B1 6/2015 Coats et al.
9,388,537 B2 7/2016 Dahm et al.
9,551,115 B2 1/2017 Engels et al.
9,663,162 B1 5/2017 Pedersen et al.
9,663,905 B2 5/2017 Dahm et al.
9,684,308 B2 6/2017 Dahm et al.
9,764,762 B2 * 9/2017 Klein ..... E01C 19/00
(Continued)

FOREIGN PATENT DOCUMENTS

DE 20000148 U1 5/2001

OTHER PUBLICATIONS

Extended European Search Report received in EP Application No. 22856535.4, Sep. 8, 2025, 9 pages.
(Continued)

*Primary Examiner* — Abigail A Risic
(74) *Attorney, Agent, or Firm* — Suiter Swantz IP

(57) ABSTRACT

Automatic pivot arm positioning of a slipform paver is described. The pivot arm is automatically controlled while changing from transport-to-pave or pave-to-transport. By the automatic control, a track section may avoid interference with adjacent track sections. The pivot arm is further automatically controlled to avoid interference between the track section and a paving mold during paving operations. Dynamic calculations may be performed to control the steering limits of the track based on current positions of the machine components. The pivot arm and track may then be controlled according to the dynamic steering limits.

26 Claims, 24 Drawing Sheets

(56) References Cited

U.S. PATENT DOCUMENTS

| | | | | |
|---|---|---|---|---|
| 9,797,099 | B2 | 10/2017 | Engels et al. | |
| 9,969,427 | B1 | 5/2018 | Engels et al. | |
| 10,029,749 | B2 | 7/2018 | Guntert et al. | |
| 10,053,167 | B2 | 8/2018 | Guntert et al. | |
| 10,161,088 | B2 | 12/2018 | Engels et al. | |
| 10,221,528 | B2 * | 3/2019 | Dahm | E01C 19/4886 |
| 10,496,106 | B2 | 12/2019 | Dahm et al. | |
| 10,589,807 | B2 | 3/2020 | Guntert, Jr. et al. | |
| 10,710,631 | B2 * | 7/2020 | Zhang | B62D 55/084 |
| 10,822,029 | B2 * | 11/2020 | Farr | E01C 19/004 |
| 11,077,732 | B2 | 8/2021 | Busley et al. | |
| 11,149,388 | B1 | 10/2021 | Pedersen et al. | |
| 11,254,359 | B1 | 2/2022 | Wulf | |
| 2011/0236129 | A1 | 9/2011 | Guntert, Jr. et al. | |
| 2013/0000996 | A1 * | 1/2013 | Miller | B60G 3/01 180/9.46 |
| 2015/0354150 | A1 | 12/2015 | Dahm et al. | |
| 2016/0244096 | A1 * | 8/2016 | Klein | B62D 11/20 |
| 2017/0344027 | A1 | 11/2017 | Dahm et al. | |
| 2018/0141597 | A1 | 5/2018 | Guntert, Jr. et al. | |
| 2018/0155883 | A1 * | 6/2018 | Engels | E01C 19/4893 |
| 2018/0208240 | A1 * | 7/2018 | Farr | E01C 19/4886 |
| 2020/0255074 | A1 * | 8/2020 | Guntert, Jr. | B62D 55/065 |
| 2021/0114655 | A1 | 4/2021 | Farr et al. | |
| 2022/0243407 | A1 * | 8/2022 | Pedersen | E01C 19/4893 |
| 2022/0389667 | A1 * | 12/2022 | Wulf | B62D 11/20 |
| 2023/0057136 | A1 * | 2/2023 | Verhaelen | E01C 19/004 |
| 2023/0322300 | A1 * | 10/2023 | Farr | B62D 11/003 |

OTHER PUBLICATIONS

International Search Report and Written Opinion received in International Application No. PCT/US22/39903, Nov. 1, 2022, 10 pages.
Gomaco Brochure, "V2 Paving Mold", Uploaded Apr. 1, 2022, 4 pages.

* cited by examiner

100

410-420

430

440

450

460

470

100

600a

PRIOR ART

600a

PRIOR ART

100

100

100

100

100

SLIPFORM PAVER CONTROL

CROSS-REFERENCE TO RELATED APPLICATIONS

The present application claims the benefit under 35 U.S.C. Section 119(e) of U.S. Provisional Application No. 63/231,961, filed Aug. 11, 2021, which is incorporated herein by reference in the entirety.

TECHNICAL FIELD

Embodiments of the invention are directed generally toward the field of paving operations, and more particularly for intelligently controlling leg assemblies.

BACKGROUND OF THE INVENTION

Slipform pavers may include a frame and a slipform mold mounted to the frame. The slipform mold may form a material into a shape as the slipform paver is driven in a paving direction. The frame may be supported by one or more pivot arms which are pivotably connected to the frame. The slipform paver may further include a track section connected to a lower portion of each pivot arm by a leg assembly. The track section may be rotated relative to the pivot arm by various means. During paving, an angle of the pivot arms may be selectively controlled relative to the frame and an angle of the track section may be controlled relative to the pivot arms to improve stability. When the slipform paver has finished paving, the pivot arms may be pivoted to an angle substantially perpendicular to the paving direction, also referred to as a transport orientation. In the transport orientation, a transport width of the slipform paver may be minimized for improved transportation capabilities between job sites. To assist in changing the angle of the pivot arm from pave to transport, the track section may be rotated substantially perpendicular to the pivot arm and then the pivot arm and track section may be engaged simultaneously.

While the pivot arms are in the transport orientation, the track section may be capable of interfering with the slipform mold. Furthermore, while changing the pivot arm from transport-to-pave or pave-to-transport the track section may be capable of interfering with an adjacent track section. Therefore, it would be advantageous to provide a device, system, and method that cures the shortcomings described above.

SUMMARY

A paving machine is described, in accordance with one or more embodiments of the present disclosure. In one illustrative embodiment, the paving machine includes a frame including a slipform mold for moving in a first direction of travel for forming a material into shape. In another illustrative embodiment, the paving machine includes a first end structure supporting at least a first portion of the frame. In another illustrative embodiment, the first end structure includes a first leg assembly, a first track section with a first track drive for propelling the frame in the first direction, and a first angle sensor. In another illustrative embodiment, the paving machine includes a first pivot arm pivotably connecting the first leg assembly to the frame. In another illustrative embodiment, the first pivot arm includes a first slew drive and a second angle sensor. In another illustrative embodiment, the paving machine includes a second end structure supporting at least a second portion of the frame.

In another illustrative embodiment, the second end structure including a second leg assembly, a second track section with a second track drive for propelling the frame in the first direction, and a third angle sensor. In another illustrative embodiment, the paving machine includes a second pivot arm pivotably connecting the second leg assembly to the frame adjacent to the first pivot arm. In another illustrative embodiment, the second pivot arm includes a second slew drive and a fourth angle sensor. In another illustrative embodiment, the paving machine includes a power supply connected to the first track drive, the first slew drive, the second track drive, and the second slew drive. In another illustrative embodiment, the paving machine includes a processor configured, via executable code, to selectively engage the first track section and the first pivot arm to avoid the second end structure based on information received from the first angle sensor, the second angle sensor, the third angle sensor, and the fourth angle sensor.

A method for pave-to-transport reconfiguration of a paving machine is described, in accordance with one or more embodiments of the present disclosure. In one illustrative embodiment, the method includes receiving a command to change a first pivot arm and a second pivot arm from a paving orientation to a transport orientation. In another illustrative embodiment, the first pivot arm is adjacent to the second pivot arm on a side of a frame of the paving machine. In another illustrative embodiment, the method includes one of simultaneously or sequentially rotating a first track section relative to the first pivot arm until the first track section is substantially perpendicular to the first pivot arm and rotating a second track section relative to the second pivot arm until the second track section is substantially perpendicular to the second pivot arm. In another illustrative embodiment, the method includes simultaneously engaging the first track section and the first pivot arm to rotate the first pivot arm relative to the frame from the paving orientation to the transport orientation and engaging the second track section and the second pivot arm to rotate the second pivot arm relative to the frame from the paving orientation to an intermediary orientation between the paving orientation and the transport orientation in which the second track section does not interfere with the first track section. In another illustrative embodiment, the method includes rotating the first track section relative to the first pivot arm until the first track section is substantially parallel to a transport direction. In another illustrative embodiment, the method includes reengaging the second track section and the second pivot arm to rotate the second pivot arm relative to the frame from the intermediary orientation to the transport orientation. In another illustrative embodiment, the method includes rotating the second track section relative to the second pivot arm until the second track section is substantially parallel to the transport direction. In another illustrative embodiment, the paving machine includes one or more processors which are configured to execute program instructions maintained on a memory for implementing the method.

A paving machine is described, in accordance with one or more illustrative embodiments of the present disclosure. In one illustrative embodiment, the paving machine includes a frame including a slipform mold for moving in a first direction of travel for forming a material into shape. In another illustrative embodiment, the slipform mold includes an adjustable width. In another illustrative embodiment, the paving machine includes a first end structure supporting at least a portion of the frame, the first end structure including a first leg assembly, the first end structure further including a first track section with a first track drive for propelling the frame in the first direction, the first end structure further including a first slew drive and a first angle sensor. In another illustrative embodiment, the paving machine includes a first pivot arm pivotably connecting the first end structure to a side of the frame, the first pivot arm including a second angle sensor. In another illustrative embodiment, the paving machine includes a power supply connected to the first track drive and the first slew drive. In another illustrative embodiment, the paving machine includes a processor configured, via executable code, to selectively engage the first track section and the pivot arm to avoid the slipform mold based on information received from the first angle sensor and the second angle sensor.

A paving machine is described in accordance with one or more embodiments of the present disclosure. In one illustrative embodiment, the paving machine includes a frame including a slipform mold for moving in a first direction of travel for forming a material into shape. In another illustrative embodiment, the paving machine includes a first end structure supporting at least a portion of the frame. In another illustrative embodiment, the first end structure includes a first leg assembly, a first track section with a first track drive for propelling the frame in the first direction, a first slew drive, and a first angle sensor. In another illustrative embodiment, the paving machine includes a first pivot arm pivotably connecting the first end structure to a side of the frame. In another illustrative embodiment, the first pivot arm includes a second angle sensor. In another illustrative embodiment, the paving machine includes a power supply connected to the first track drive and the first slew drive. In another illustrative embodiment, the paving machine includes a proximity sensor configured to capture a distance data of an external object relative to the paving machine. In another illustrative embodiment, the paving machine includes a processor configured, via executable code, to selectively engage the first track section and the pivot arm to avoid the external object based on the distance data received from the proximity sensor and angular position data received from the first angle sensor and the second angle sensor.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1A:
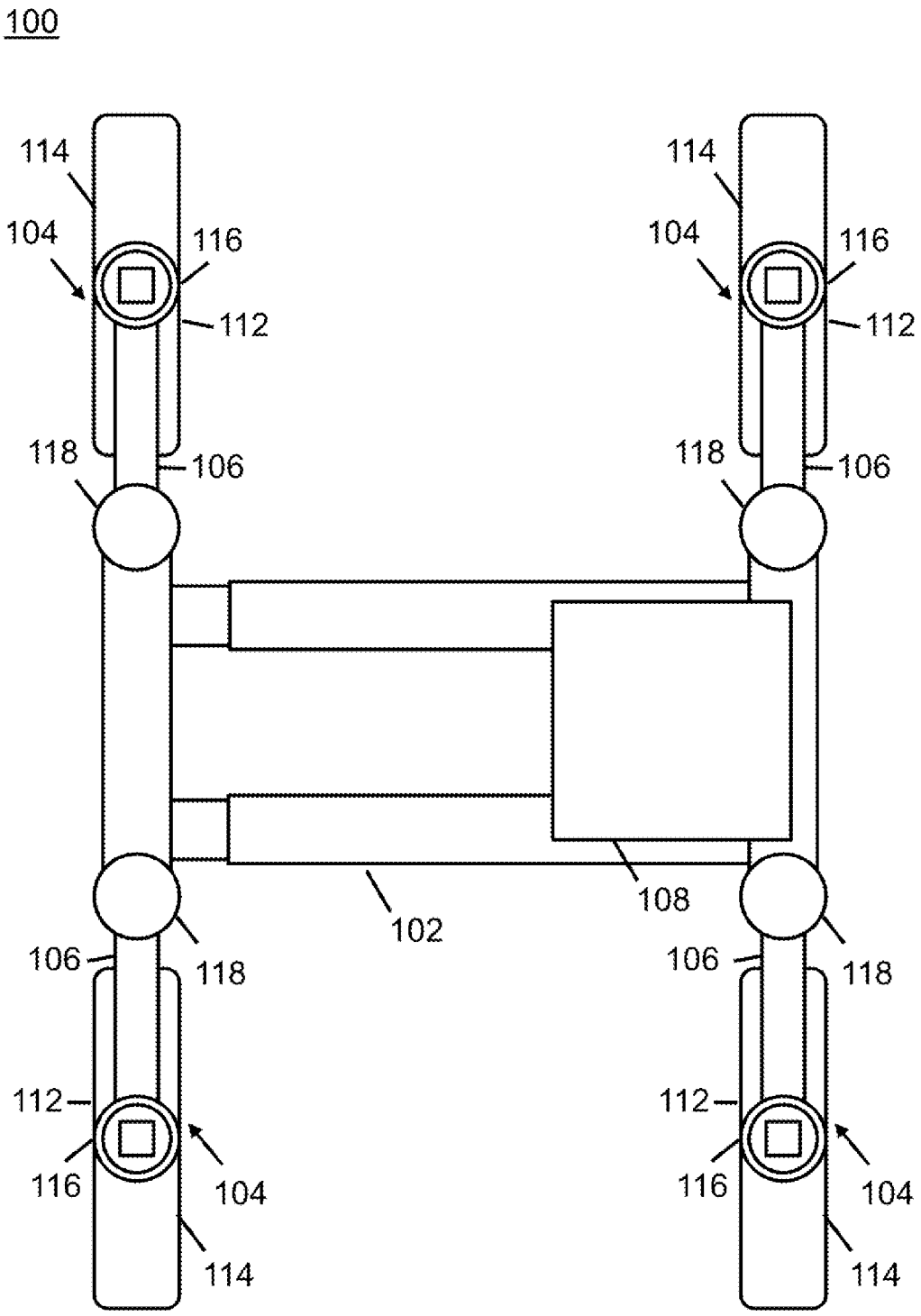
FIG. 1A depicts a simplified top view of a paving machine, in accordance with one or more embodiments of the present disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment", "in embodiments", or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Reference will now be made in detail to the subject matter disclosed, which is illustrated in the accompanying drawings. Embodiments of the present disclosure are directed to dynamically controlling a steering limit for a pivot arm and a track section.

A user may input a change to a pivot arm angle or a track section angle of a slipform paver. The change may include a target location, such as a change from transport-to-pave, from pave-to-transport, or a pave-to-pave (e.g., to avoid an object currently in the paving path). In response to the input, a current position of the pivot arm may be determined and compared with the desired position. Where the target pivot location for the new direction of travel is not acceptable, the control system may navigate the user to a setup screen for the pivot arm. For example, the target pivot location may be unacceptable where the track section or pivot arm will interfere with the slipform mold. At the setup screen, the user may be prompted to enter information for each pivot arm of the machine. In the event the user attempts to navigate away from the pivot swinging setup screen, the control system may navigate the display to prompt the user for a next course of action. Where the pivot arm is not at the desired position, the user may be prompted that the machine must be in a safe state to continue, the pivot arm may be rotated to the desired position and the track section may be reoriented to be parallel with the new direction of travel, in accordance with one or more pivot swinging processes described herein. During reorientation, the pivot arm and/or the crawler track may run into another component of the paving machine. In some cases, the components of the paving machine may be movable relative to one another. In embodiments, the paving machine is configured to determine an internal steering limit which the leg assemblies may not be driven beyond. The steering limits may be calculated by the paving machine based on a position of one or more of the components.

One or more pave-to-transport control features are now described. An automatic feature may be provided in which an operator presses a button to automatically reconfigure the machine from a paving configuration to a transport configuration (or vice versa). In some embodiments, one pivot arm is reoriented at a time. In further embodiments, multiple pivot arms may be reoriented at a time, thereby reducing reconfiguration time. Appropriate actions may be taken to avoid interference between adjacent pivot arms while simultaneously reconfiguring the adjacent pivot arms. If more than one pivot is enabled on a side of the machine (sides of the machine being relative to the paving direction of travel) the pivot arm closer to the final position may be given priority or right-of-way over the pivot arm further from the final position. The non-priority pivot may then be driven slower and/or to a position that will not interfere with the priority pivot. During the reconfiguration, the paving machine may dynamically determine maximum steer limits for the leg assemblies. Such dynamic control may also be referred to as an "Automatic Steer Limit Mode". Once the priority pivot reaches the target location, the priority pivot drive and track drive are stopped. The priority track is then steered to be parallel with the travel direction. Once the priority leg assembly has reached a certain point in the reconfiguration, the steering limits may be opened up. The non-priority pivot is then driven to its target. Upon reaching the target position, the non-priority track of the nonpriority pivot arm is steered to be parallel with the travel direction. By such sequencing, interference between adjacent track sections may be avoided. Alternatively and/or additionally, the non-priority pivot arm may be rotated with a lower angular velocity than the priority pivot arm to be maintained within the steering limits.

Referring generally to FIGS. 1A-10, a slipform paver (also referred to as a paving machine 100) is disclosed, in accordance with one or more embodiments of the present disclosure. The slipform paver may be driven onto a trailer for loading. Prior to being driven onto the trailer, pivot arms and track sections of the slipform paver may be reconfigured from a paving orientation to a transport orientation. Similarly, where the slipform paver is being unloaded from the trailer, the slipform paver may be driven off of the trailer and the pivot arms and the track sections may be reconfigured from the transport orientation to the paving orientation. Such transport-to-pave or pave-to-transport reconfiguration may be performed by a processor implementing a method of transport reconfiguration, such as method 400. By implementing the method, adjacent track sections may be prevented from interfering with each other. Similarly, during paving operations the pivot arms and track sections may be selectively controlled to prevent interference with a slipform mold. Where the mold is configured for lateral shifts along the frame, the slipform paver may accommodate for such shifts when controlling the track sections, such as where the slipform mold is width-adjustable.

Figure 1B:
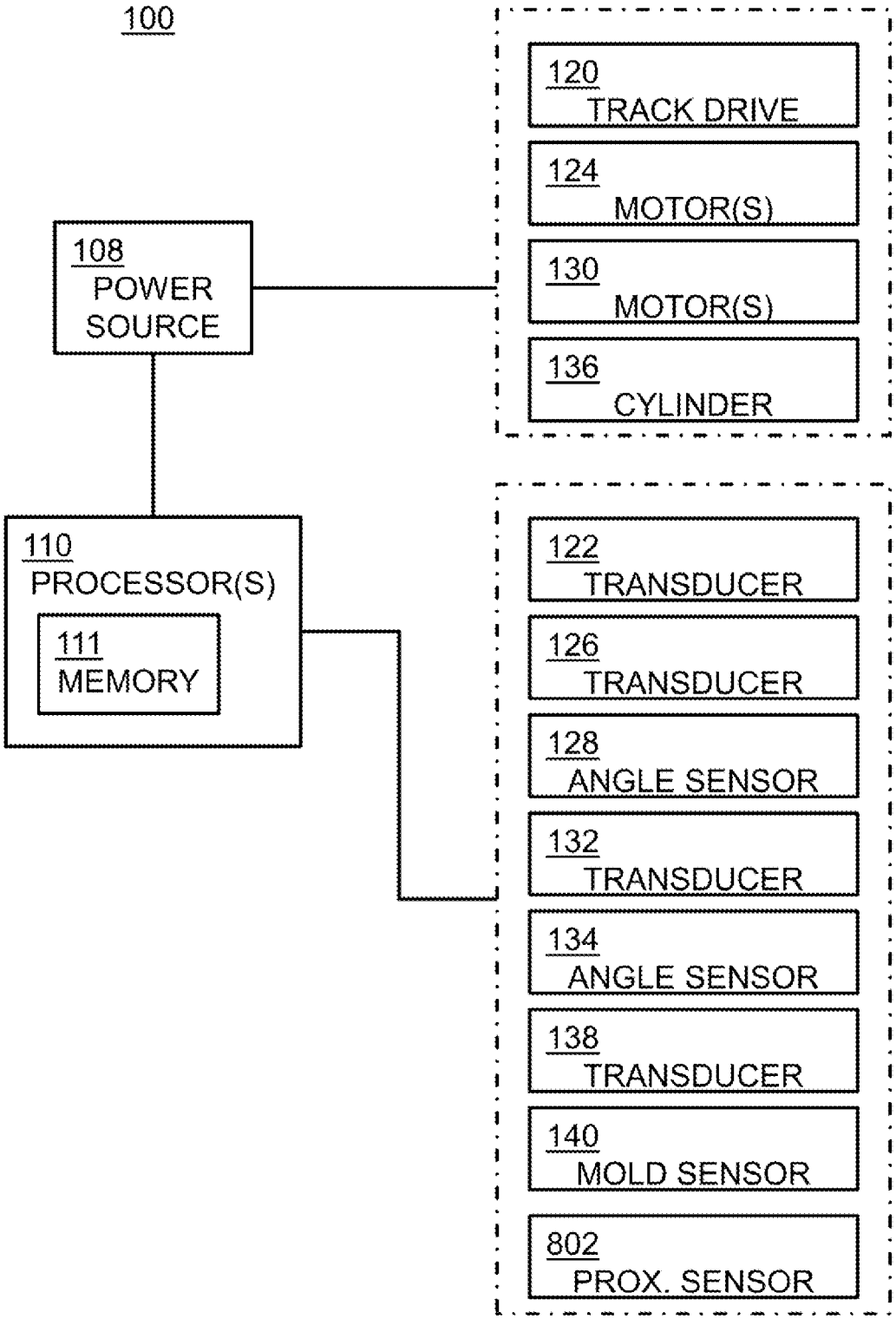
FIG. 1B depicts a schematic diagram of a control system of the paving machine, in accordance with one or more embodiments of the present disclosure.

Referring now to FIGS. 1A-1B, a paving machine 100 is described, in accordance with one or more embodiments of the present disclosure. The paving machine 100, may include any suitable paving machine, such as, but not limited to, a slipform paver. The paving machine 100 may include one or more of frame 102, end structures 104, pivot arms 106, power source 108, and processor 110. The frame 102 may include a slipform mold 600 (see FIG. 6). The slipform mold may be moved in a first direction of travel for forming a material into shape. For example, the material may include concrete to be formed into a roadway. The slipform mold may be mountable below the frame 102. In some embodiments, the frame 102 include an adjustable width, although this is not intended to be limiting. The power source 108 may be connected to the frame 102. The power source 108 may include any power source configured to generate power known in the art, such as, but not limited to, a gasoline engine, a diesel engine, or an electric power source of various sizes and power ratings. The power source 108 may be configured to supply the power to one or more components of the paving machine 100. For example, the power source 108 may generate hydraulic power (e.g., by a hydraulic pump) or electric power for supplying to one or more components. The power source 108 may be configured to one or more of stop, slow, or reverse a first drive or stop, slow, or reverse one or more other drives to mitigate an under or over drive of the first drive.

The paving machine 100 may further include one or more end structures 104. For example, the paving machine 100 may include two, three, or four end structures 104. The end structures 104 may support at least a portion of the frame 102. In this regard, the end structures 104 may be configured to support from 10,000 pounds to 27,000 pounds, or more. The end structure 104 may include a leg assembly 112. The leg assembly 112 may be configured to adjust a height of the frame 102 relative to a ground surface. In this regard, the leg assembly 112 may include an outer tube portion and an inner tube portion coupled by a linear actuator, such that the outer tube portion and the inner tube portion may be configured to telescope relative to one another. The linear actuator may include a hydraulic cylinder 136 (i.e., a smart cylinder) including one or more position transducers for determining a height of the leg assembly 112. For example, the hydraulic actuator 136 may be similar to that described in U.S. Pat. No. 7,284,472, by Dan D. Soellner et al, titled "HYDRAULIC CYLINDER", which is incorporated herein by reference in the entirety. Such hydraulic cylinder 136 may include a linear transducer 138 (e.g., a wand and wiper assembly) for monitoring a displacement of the hydraulic cylinder 136, although this is not intended to be limiting.

The end structure 104 may include a track section 114. Such track section 114 may also be referred to as a crawler assembly, a continuous track, or a caterpillar track, among other names. The track section 114 may be disposed below the leg assembly 112 and coupled to the leg assembly 112 by a yoke. Power may be supplied from the power source 108 to the track section 114 (e.g., to a track drive 120 of the track section). In response to receiving the power, the track drive 120 may turn an endless track of the track section 114. By turning the endless track, the paving machine 100 may be propelled in the paving direction. The track drive 120 may also be used to assist in pivoting the pivot arm 106 (i.e., pivoting on-the-go, stationary pivoting, crab steer, etc.).

The end structure 104 may include a slew drive 116. The slew drive 116 may be configured to adjust an angle of the track section 114 relative to the pivot arm 106. Power may be supplied from the power source 108 to the slew drive 116. In response to receiving the power, the slew drive 116 may adjust the angle of the track section 114 relative to the pivot arm 106. In this regard, the slew drive 116 may be considered to control a steering angle of the track section 114. For example, the slew drive 116 may include one or more motors 124 (e.g., two motors). The motor(s) 124 may receive the power from the power source 108 and rotate one or more components of the slew drive 116 for adjusting the angle of the track section 114 relative to the pivot arm 106. The slew drive 116 may be coupled in a variety of configurations for adjusting the angle. For example, the slew drive 116 may be coupled between the inner tube portion of the leg assembly and the track section 114, as described in U.S. Pat. No. 9,764,762, titled "ROTARY PIVOT ARM POSITIONING ASSEMBLY", which is incorporated herein by reference in the entirety. By way of another example, the slew drive 116 may be coupled between the outer tube and the inner tube, as described in U.S. Pat. No. 11,254,359, "titled "LEG ASSEMBLY FOR CONSTRUCTION MACHINE", which is incorporated herein by reference in the entirety.

The paving machine 100 may include one or more pivot arms 106. The pivot arms 106 may pivotably connect the end structure 104 with the frame 102. In this regard, each pivot arm 106 may be coupled with an associated end structure 104. In some embodiments, the pivot arms 106 are pivotably connected to the frame by a slew drive 118, although this is not intended as a limitation on the present disclosure. In this regard, the pivot arms 106 may be coupled in any manner, such as, but not limited to, a slew drive, a ratcheting assembly, a four-bar-linkage configuration of a hydraulic cylinder, or a planetary drive. The slew drive 118 may be configured to adjust an angle of the pivot arm 106 relative to the frame 102. Power may be supplied from the power source 108 to the slew drive 118. In response to receiving the power, the slew drive 118 may adjust the angle of the pivot arm 106 relative to the frame 102. For example, the slew drive 118 may include one or more motors 130 (e.g., two motors). The motor(s) 130 may receive the power from the power source 108 and rotate one or more components of the slew drive 118 for adjusting the angle of the pivot arm 106 relative to the frame 102.

Referring now to FIG. 1B, a simplified control diagram of the paving machine 100 is described, in accordance with one or more embodiments of the present disclosure. The paving machine 100 may further include one or more processors 110 and a memory 111. The processor 110 may be communicatively coupled with one or more components of the paving machine 100. For example, the processor 110 may be communicatively coupled with one or more of the power source 108, the memory 111, or a batch of sensors. The processor 110 may be configured to execute a set of program instructions maintained on the memory 111. The set of program instructions may be configured to cause the processor 110 to carry out the steps of the present disclosure. The processor 110 may selectively engage one or more components by providing power from the power source 108 to an associated hydraulic drive or electric drive of the component. In this regard, the processor 110 may engage one or more of the track section 114 (i.e., track drive 120), the slew drive 116 (i.e., motor(s) 124), the slew drive 118 (i.e., motor(s) 130), the leg assembly 112 (i.e., the hydraulic cylinder 136), the slipform mold 600, and the like. The processor 110 may selectively engage the various components by sending one or more electrical signals to an associated valve, releasing a flow of hydraulic fluid to the associated component from a hydraulic pump. The processor 110 may engage the slew drive 116 by providing power from the power source 108 to the motors 124. Similarly, the processor 110 may engage the slew drive 118 by providing power from the power source 108 to the motors 130. Similarly, the processor 110 may engage the track drive 120 by providing power from the power source 108 to the track drive 120. Furthermore, the processor 110 may be configured to control an amount of power provided to the component. In this regard, the processor 110 may be configured to control a hydraulic power supplied by one or more hydraulic valves or control an electrical power supplied by a switching circuit. Such hydraulic valves may include any hydraulic valve, such as, but not limited to, an Eaton CMA valve or a DO3 valve.

The slew drive 116 may be used to rotate the track section 114 relative to the pivot arm 106. In this regard, a command may be received to change the angle of the track section 114. The track section 114 may be adjusted to the desired angle by the slew drive 116. Additionally, one or more of the slew drive 118 or the track drive 120 may be used to rotate the pivot arm relative to the frame. In this regard, a command may be received to change the angle of the pivot (e.g., pave-to-transport or transport-to-pave). The processor 110 may determine an appropriate angle of the track section 114. The track section 114 may be adjusted to the desired angle by the slew drive 118. When the track section 114 is at the appropriate angle, the track drive 120 and the slew drive 118 may be engaged, with the track drive 120 reducing a torque requirement of the slew drive 118. The helper angle may be determined based on a steering limit of the paving machine 100. For instance, where the angle of the pivot arm 106 is being changed while the frame 102 is stationary, the steering limit may be set to a maximum amount (e.g., ninety degrees relative to the pivot arm 106, or more).

The processor 110 may receive various measurements from one or more of sensors indicating the angular rotation of the one or more of the track section 114 relative to the pivot arm 106 or the angular rotation of the pivot arm 106 relative to the frame 102. For example, the processor may receive measurements from an angle sensor 128 or an angle sensor 134. The slew drive 116 may include the angle sensor 128 for determining relative rotational movements. By the angle sensor 128, the angle of the track section 114 relative to the pivot arm 106 may be determined. For example, the relative rotational movements of the slew drive 116 between a first angle and a second angle may correspond to a similar rotational movement of the track section 114 between the first angle and the second angle. Similarly, the slew drive 118 may include the angle sensor 134 for determining relative rotational movements of the slew drive 118. By the angle sensor 134, the angle of the pivot arm 106 relative to the frame 102 may be determined. For example, the relative rotational movements of the slew drive 118 between a third angle and a fourth angle may correspond to a similar rotational movement of the pivot arm 106 between the third angle and the fourth angle. The measurements from the angle sensor 128 and the angle sensor 134 may be implemented in one or more methods, as described further herein. The angle sensors 128, 134 may include any angle sensor known in the art, such as, but not limited to, a rotary encoder, a tachometer, a quadrature sensor, or an absolute encoder. The processor 110 may also selectively engage one or more of the slew drive 116, the slew drive 118, or the track drive 120 based on the various measurements from one or more of sensors indicating the angular rotation the one or more of the track section 114 relative to the pivot arm 106 or the angular rotation of the pivot arm 106 relative to the frame 102.

The processor 110 may also receive various measurements from one or more of the sensors indicating the load of the one or more of the drives. For example, the slew drive 116 may include a pressure transducer 126. The pressure transducer 126 may measure the hydraulic pressure of the hydraulic fluid supplied to the slew drive 116. The slew drive 116 may encounter a load (i.e., for steering the track section 114). By way of another example, the slew drive 118 may include a pressure transducer 132. The pressure transducer 132 may measure the hydraulic pressure of the hydraulic fluid supplied to the slew drive 118. The slew drive 118 may encounter a load (i.e., for pivoting the pivot arm 106). By way of another example, the track drive 120 may include a pressure transducer 122. The pressure transducer 122 may measure the hydraulic pressure of the hydraulic fluid supplied to the track drive 120. The track drive 120 may encounter a load (i.e., to propel the endless track). Thus, the processor may receive measurements from the pressure transducer 122, the pressure transducer 126, or the pressure transducer 132. Such pressure transducers 122, 126, 132 may include any pressure transducers known in the art, such as, but not limited to, potentiometric pressure sensors, inductive pressure sensors, capacitive pressure sensors, piezoelectric pressure sensors, variable reluctance pressure sensors. The hydraulic cylinder 136 of the height-adjustable leg assembly 112 may include a linear transducer 138. In some embodiments, the paving machine includes a slipform mold with an adjustable width (e.g., mold 600). A mold sensor 140 may detect a current position of the slipform mold. Such mold sensor 140 may include any suitable sensor, as will be described further herein with reference to FIG. 6.

The processor 110 may monitor the various sensors to anticipate a need for a change in rate or direction of a single drive or a set of drives in a programmed choreographed position, configuration, or steering change. In this regard, the processor 110 may receive various information from the sensors and control the drives for executing a desired operation, such as, but not limited to, the steps in one or more methods described herein. The processor 110 may selectively engage one or more of the slew drive 116, the slew drive 118, or the track drive 120 based on one or more measurements from one or more of the pressure transducer 122, the pressure transducer 126, the angle sensor 128, the pressure transducer 132, the angle sensor 134, or the linear transducer 138. For example, the processor 110 may determine one or more of the slew drive 116 or the slew drive 118 is seized based on measurements from one or more of the pressure transducer 122, the pressure transducer 126, the angle sensor 128, the pressure transducer 132, or the angle sensor 134 and correct the seizure as described in U.S. Pat. No. 11,149,388, by Scott Pedersen et al, titled "SLEW DRIVE CONTROL", which is incorporated herein by reference in the entirety. In the event the leg assembly runs into something (whether on or off machine), the paving machine 100 may intelligently control the leg assembly to prevent the leg assembly from breaking the slew drive 116 or the slew drive 118.

In some embodiments, the processor 110 may selectively engage one or more of the slew drive 116, the slew drive 118, or the track drive 120 to prevent the track section or the pivot arm 106 from interfering with another of the components, thereby preventing damage to the machine. The various components may be selectively engaged based on an angular position of the components, as determined by an associated angle sensor. The angular position may be limited by a steering limit, thereby preventing the various components from entering a no-go zone, as will be described further herein.

In some embodiments, a local reference frame may be used to assist in determining the no-go zone. For example, the processor 110 may define a local coordinate system by which one or more components of the paving machine 100 may be defined, as described in U.S. patent application Ser. No. 17/087,465, published as 2021/0114655, by Thomas C. Farr et al, titled "Paving Machine with Smart Steering Control", which is incorporated herein by reference in the entirety. As may be understood, any portion of the frame 102 may serve as the reference frame for the coordinate system, such as, but not limited to, a rear left corner of the frame 102. In this regard, the frame may serve as a reference frame, without requiring input from a real time kinematic ("RTK") GPS system, or other such system, thereby allowing for relative positioning of the pivot arm 106 and track section 114 independently of the current orientation of the frame 102. As the paving machine 100 is being reconfigured from transport-to-pave or pave-to-transport, an RTK GPS system (i.e., a total station) may or may not be setup. Advantageously, defining the local coordinate system by reference to the frame 102 may provide for various automatic machine control, where the RTK GPS system is not currently setup. Although the processor 110 is described as determining the local coordinate system without reference to the RTK GPS system, this is not intended as a limitation on the present disclosure. In this regard, the processor 110 may further receive various external information, such as from an RTK GPS system, stringline, laser mast, or other method. Furthermore, the processor 110 may selectively control various drives without generating the local coordinate system.

As may be understood, not all components of the control diagram are depicted for clarity. For example, the paving machine 100 may include a hydraulic pump which receives a mechanical drive or electrical power from the power source and generates a flow of hydraulic fluid with hydraulic power. By way of another example, the paving machine 100 may include one or more valves disposed between the hydraulic pump and the various components, which the processor 110 may selectively control for engaging and disengaging the various components.

A paving machine 100 may include one or more components, such as adjacent crawler tracks, mold 600, barrier attachment 702, conveyor 704, and the like, which the pivot arm 106 and the track section 114 may be dynamically controlled to avoid collision with components of the paving machine 100. As may be understood, the paving machine 100 may include any one or more of the components. Commonly, not all of the components may be attached at a given time. Therefore, it is desirable to determine which components are currently attached to the machine and control the pivot arm 106 and the track section 114 accordingly. In embodiments, a user may input the machine configuration on a display. In embodiments, the components are coupled to a controller area network (CAN) bus of the paving machine 100. The components may be configured to transmit an identifier on the CAN bus, such as, but not limited to a CAN identifier including a 11-bit identifier or a 29-bit identifier. The processors 110 may receive the CAN identifier and compare the CAN identifier to a list of identifiers and associated components stored in memory 111. The processors 110 may thus determine whether the mold 600, the barrier attachment 702, or the conveyor 704 is coupled to the paving machine 100 based on the signals received from the CAN bus. The memory 111 may also include a database of dimensions and/or steering limits for the components, which may then be used by the processors 110 to control the pivot arm 106 and the track section 114.

Figure 2:
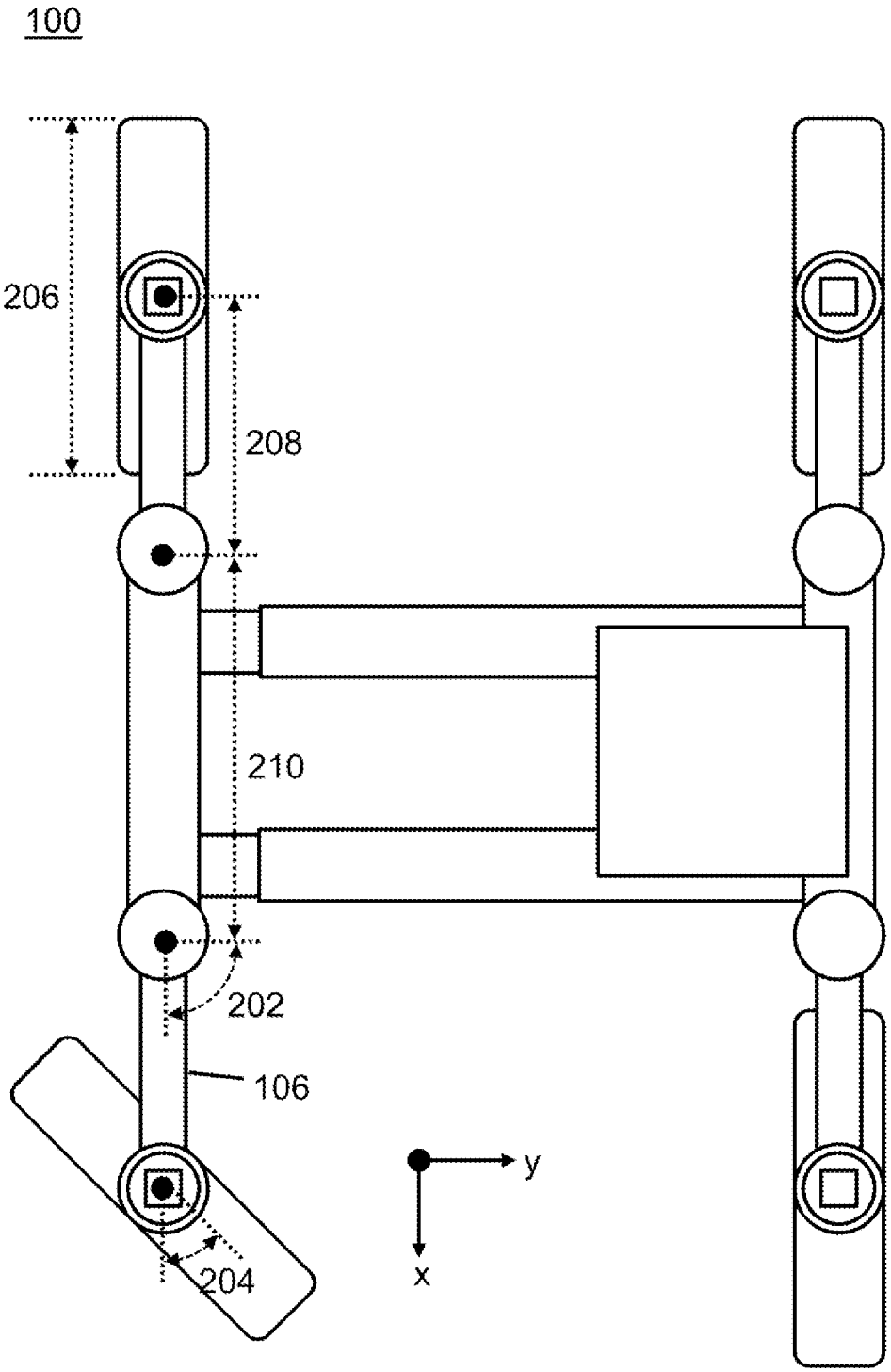
FIG. 2 depicts a simplified top view of a paving machine, in accordance with one or more embodiments of the present disclosure.

Referring now to FIG. 2, the paving machine 100 is further described, in accordance with one or more embodiments of the present disclosure. In some embodiments, a kinematic model may be generated for various components of the paving machine 100. Such kinematic model may be computer generated for selectively controlling components of the paving machine 100 during operation. For example, the kinematic model may be generated by the processor 110 in situ for selectively controlling one or more components of the paving machine 100. The kinematic model may also/alternatively be pre-generated for establishing a lookup table or other pre-stored values on the memory 111.

The kinematic model may include representing couplings of various components (e.g., frame 102, pivot arm 106, leg assembly 112, track section 114, etc.) of the paving machine 100 as kinematics pairs, together with known or expected dimensions of the components (e.g., length, width, height, volume, etc.).

For example, exemplary kinematic pairs are described where the paving machine 100 is configured as described in U.S. Pat. No. 9,764,762, titled "ROTARY PIVOT ARM POSITIONING ASSEMBLY", which is incorporated by reference above. The pivot arm 106 may be coupled to the frame 102 by a revolute joint (e.g., the slew drive 118) with one degree of freedom. The degree of freedom may be an angle 202. During operation of the paving machine 100, the angle 202 may be received by one or more sensors (e.g., by the angle sensor 128). The outer tube portion of the leg assembly 112 may be fixed to the pivot arm 106 with no degrees of freedom. The inner tube portion of the leg assembly 112 may be coupled to the outer tube portion by a prismatic joint (e.g., by the hydraulic cylinder 136) with one degree of freedom. The degree of freedom may be a linear displacement (not depicted). During operation of the slipform paver, the linear displacement may be received from one or more sensors (e.g., the linear transducer 138). The track section 114 may be coupled to the inner tube portion of the leg assembly 112 by a revolute joint (e.g., the slew drive 116) with one degree of freedom. The degree of freedom may be an angle 204. During operation of the paving machine 100, the angle 204 may be received from one or more sensors (e.g., the angle sensor 134).

Although the inner tube portion of the leg assembly 112 is described as being coupled to the outer tube portion by a prismatic joint with one degree of freedom and the track section 114 is described as being coupled to the inner tube portion of the leg assembly 112 by a revolute joint with one degree of freedom, this is not intended as a limitation on the present disclosure. For example, exemplary kinematic pairs are described where the paving machine 100 is configured as described in U.S. Pat. No. 11,254,359 LEG ASSEMBLY APPLICATION, titled "LEG ASSEMBLY FOR CONSTRUCTION MACHINE", which is incorporated by reference above. The pivot arm 106 may be coupled to the frame 102 by a revolute joint (e.g., the slew drive 118) with one degree of freedom. The degree of freedom may be an angle. During operation of the paving machine 100, the angle may be received from one or more sensors (e.g., by the angle sensor 128). The outer tube portion of the leg assembly 112 may be fixed to the pivot arm 106 with no degrees of freedom. The inner tube portion of the leg assembly 112 may be coupled to the outer tube portion by cylindrical joint (e.g., by the slew drive 116 and the hydraulic cylinder 136) with two degrees of freedom. The two degrees of freedom may include an angle and a linear displacement. During operation of the paving machine 100, the angle may be received from one or more sensors (e.g., the angle sensor 134). During operation of the paving machine 100, the linear displacement may be received from one or more sensor (e.g., the linear transducer 138).

Thus, components of the paving machine 100 may be represented as kinematics pairs. The kinematic pairs may further be dynamically represented based on various known dimensions of the components. Such various known dimensions may include, but are not limited to, a track section length 206, pivot arm length 208, and a pivot arm joint distance 210. As may be understood, the track section length 206, the pivot arm length 208, and the pivot arm joint distance 210 may include a variety of suitable dimensions. However, in some embodiments, the track section length 206 may be at least half of the pivot arm joint distance 210. In this regard, track sections 114 may interfere with adjacent track sections when the pivot arms 106 are disposed in the transport orientation and the track sections are substantially perpendicular to the pivot arms. Thus, the various components may be dynamically represented. For example, the position and orientation of the track section relative to a reference point may be calculated based on the steering angle 204 and the pivot angle 202.

The dynamic representation may take the form of points, a two-dimensional area, or a three-dimensional volume of the pivot arms 106 and the track sections 114 in relative position to the frame 102. Such two-dimensional area may be provided in a plane, such as from a top-view of the paving machine 100. Determining such two-dimensional area may require reduced computations as compared to determining the three-dimensional volume. Furthermore, the two-dimensional area may be beneficial where the hydraulic cylinder 136 does not include the linear transducer 138, such that the relative height of the track section 114 may be ignored. However, computing the three-dimensional volume may provide further situational awareness in selectively controlling various components.

In some embodiments, steering limits and/or no-go zones may be determined for one or more components of the paving machine 100. The steering limits and/or no-go zone may be determined based on the previously described kinematic modelling. The steering limits may indicate an angular position at which the component enters the no-go zone. The no-go zone may indicate a region (i.e., an area or volume) relative to the frame 102 (or other local reference frame), in which one or more components of the paving machine 100 may interfere with one or more other components of the paving machine 100. Such components may include, but are not limited to, the pivot arm 106, the track section 114, or the slipform mold 600. For example, a no-go zone may indicate the track section 114 may interfere with an adjacent track section 114 during transport reconfiguration and/or during a paving operation. The steering limits associated with the no-go zone may indicate angular positions of the pivot arm relative to the frame together with angular positions of the track sections relative to the pivot arm in which a first of the leg assemblies interferes with a second of the leg assemblies. By way of another example, a no-go zone may indicate the track section 114 or another component of the leg assembly may interfere with the slipform mold, a dowel bar inserter, conveyor, trimmer, drag pan, or the like.

In some embodiments, the steering limit and/or no-go zone is determined by the processor 110 during paving operations. Where the steering limit and/or the no-go zone is determined by the processor 110, the steering limit and/or the no-go zone may be continually updated based on changing measurements from the paving machine 100. In some embodiments, various no-go zones and the associated steering limits are predetermined and stored in the memory 111. The various no-go zones and associated steering limits may be stored in the memory 111 as a lookup table or similar pre-stored information (e.g., maximum pivot arm angle during reconfiguration).

In some embodiments, the processor 110 may selectively control various components to avoid the no-go zone. The selective control may include feedback (or other loop-based control) from the angle 202 and/or the angle 204, as determined by one or more sensors. For example, the processor 110 may control the components to avoid the no-go zone based on various measurements from one or more of the pressure transducer 122, the pressure transducer 126, the angle sensor 128, the pressure transducer 132, the angle sensor 134, the linear transducer 138, or the mold sensor 140.

In some embodiments, the processor 110 may control the components within the steering limits to avoid the no-go zone by executing code similar to a process described in regards to the method 400.

In some embodiments, the processor 110 may control the components within the steering limits to avoid the no-go zone by executing code to reduce an angular velocity of a non-priority pivot arm below an angular velocity of a priority pivot arm. The angular velocity of the pivot arms may be controlled based on an amount of power provided to the slew drive 118 (e.g., the motor 124 of the slew drive 118) coupling the pivot arm 106 with the frame 102 and/or based on an amount of power provided to track section 114 (e.g., track drive 120 of the track section 114). In this regard, the priority pivot arm may be driven to the desired position faster than the non-priority pivot arm, thereby avoiding interference between adjacent track sections. In some embodiments the amount of power is determined by the processor 110 based on a kinematic model in-situ. In some embodiments, the amount of power is determined by the processor 110 by performing a lookup in a lookup table or other similar method (e.g., predetermined priority and non-priority angular velocities).

Figure 3:
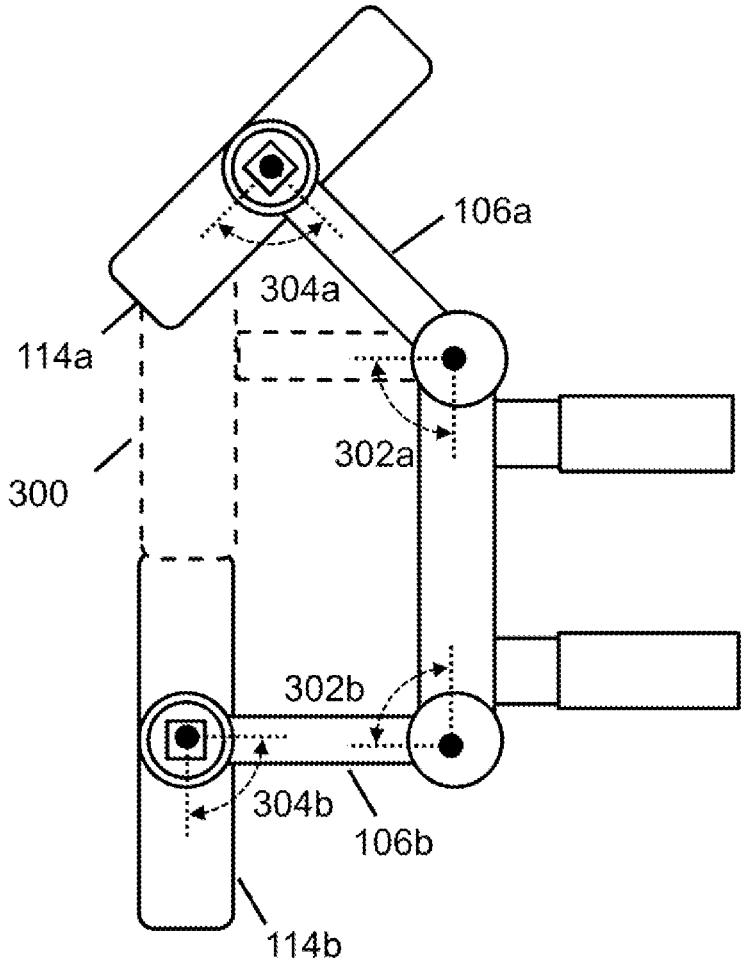
FIG. 3 depicts a simplified top view of a no-go zone of a paving machine, in accordance with one or more embodiments of the present disclosure.

Referring now to FIG. 3, a no-go zone 300 is described, in accordance with one or more embodiments of the present disclosure. The no-go zone 300 may be determined by the kinematic model, as previously described. The no-go zone 300 may indicate an angle 302*a* (or range of angles) of the pivot arm 106*a* together with an angle 304*a* (or range of angles) of the track section 114*a*, at which the track section 114*a* will interfere with an adjacent track section 114*b* while the pivot arm 106*a* is at an angle 302*a* (or range of angles) and the adjacent pivot arm 106*b* is at an angle 302*b* (or range of angles), such as when the pivot arm 106*a* and pivot arm 106*b* are being reconfigured from pave-to-transport or transport-to-pave.

Although FIG. 3 depicts the angle 302*b* of the pivot arm 106*b* being at substantially ninety-degrees relative to the frame 102 in the transport orientation, this is not intended as a limitation on the present disclosure. In this regard, the angles 302 of the pivot arms 106 in the transport orientation may be less than ninety degrees, as is known in the art, thereby further reducing the transportation width. Furthermore, the angle 302 of the pivot arm 106 while in the paving orientation may be between a wide range of angles, such as, but not limited to, one hundred and eighty degrees or less. Furthermore, the various angles provided herein may be dependent upon where the angle 302 is referenced from (i.e., a null position), such that the exemplary angles are not intended to be limiting.

Although the no-go zone 300 and the associated steering limits are described in the context of automatic pave-to-transport reconfiguration, this is not intended as a limitation of the present disclosure. Selectively controlling the pivot arms and the track sections may be applicable to various other machine control operations of the paving machine 100. For example, in some circumstances a human operator may provide a control signal to the paving machine 100. The control signal provided from the human operator may cause one or more of the pivot arms and/or track sections to interfere with adjacent pivot arms and/or adjacent track sections. Such interference may cause damage to the paving machine 100. To prevent the interference, the processor 110 may periodically compute the current position of the pivot arms 106 and the track section 114 based on the angle 302 and the angle 304 and then determine whether the human operator input will result in interference (e.g., enter the no-go zone 300). In the event of computed interference, the processor 110 may override the human input to prevent such interference and/or provide a notification to the human operator by way of a display. The processor 110 may override the human input by dynamically updating steering limits for the paving machine 100 based on the current angular positions of the pivot arm 106 and the lower track assembly 114.

Figure 4:
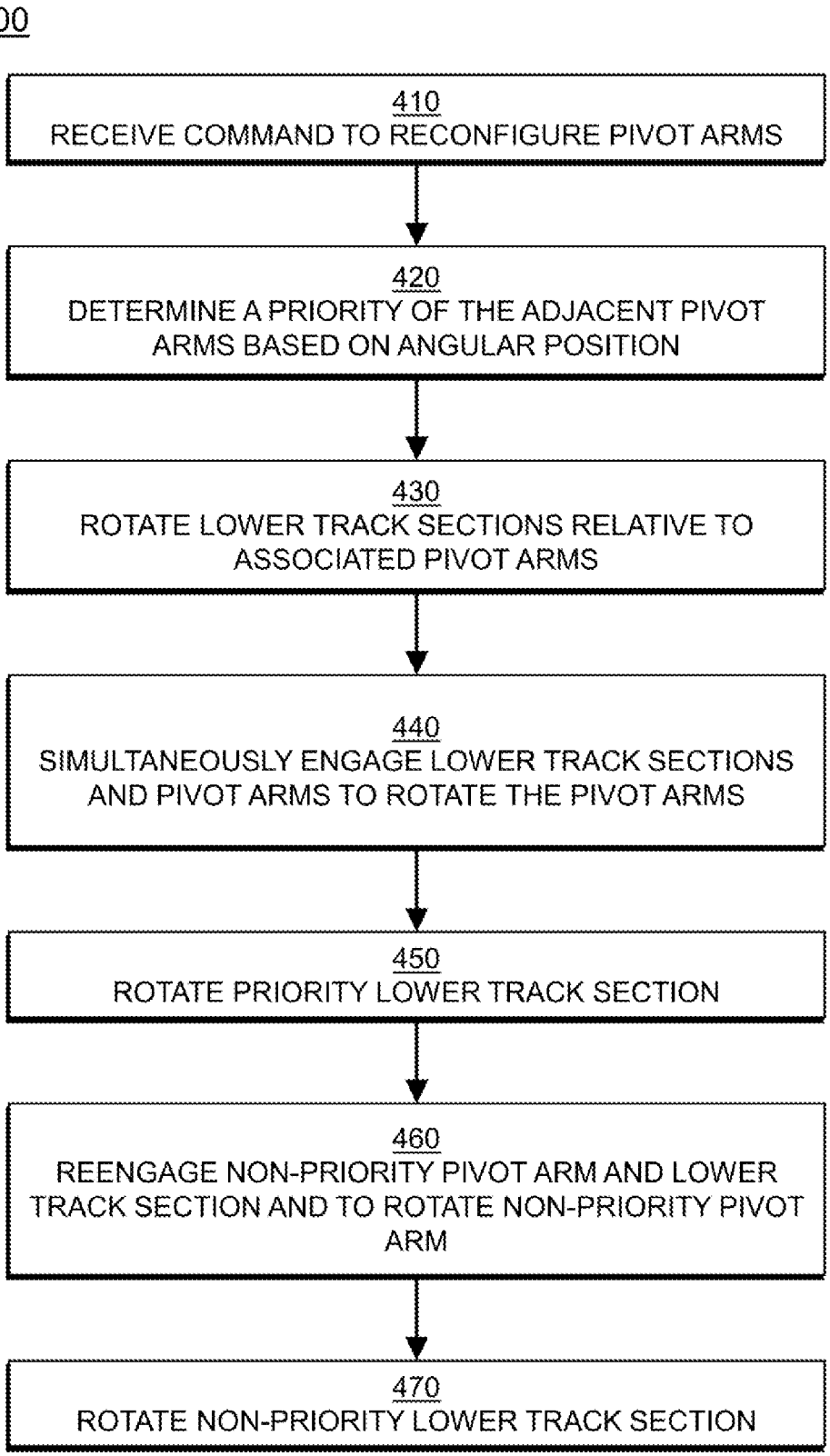
FIG. 4 depicts a flow diagram of a method of transport conversion, in accordance with one or more embodiments of the present disclosure.
Figure 5A:
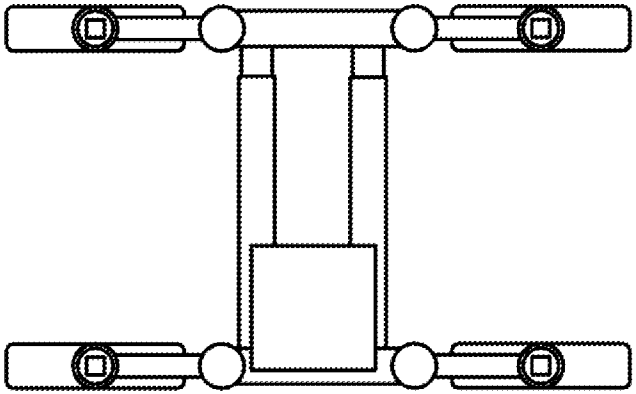
FIGS. 5A-5F depicts a simplified top view of a paving machine implementing a method of transport conversion, in accordance with one or more embodiments of the present disclosure.
Figure 5B:
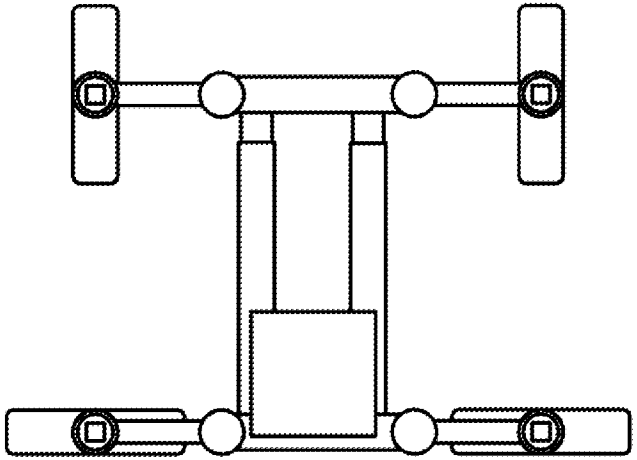
Figure 5C:
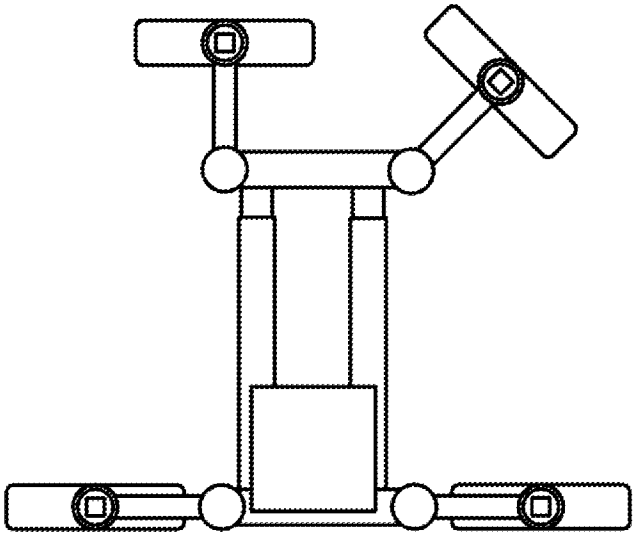
Figure 5D:
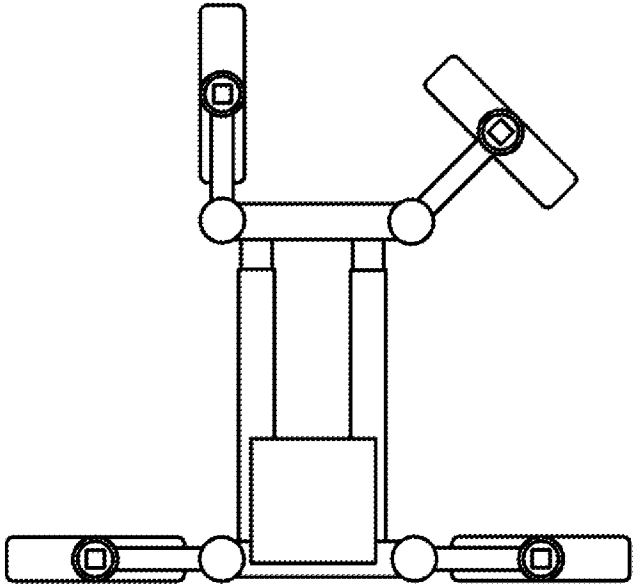
Figure 5E:
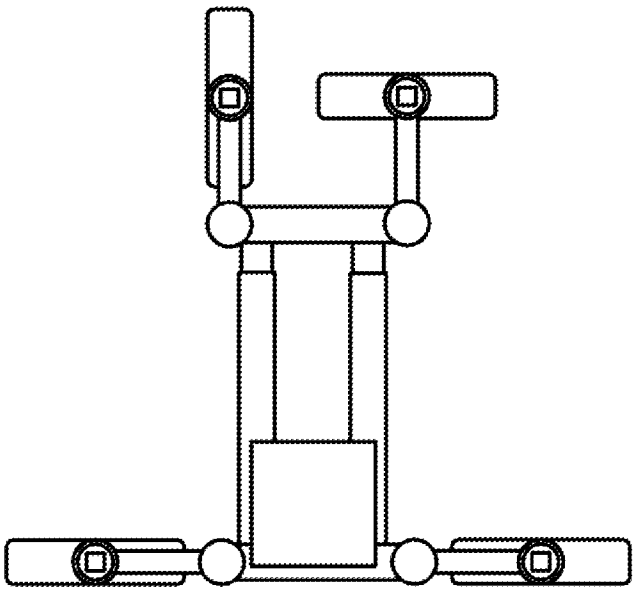
Figure 5F:
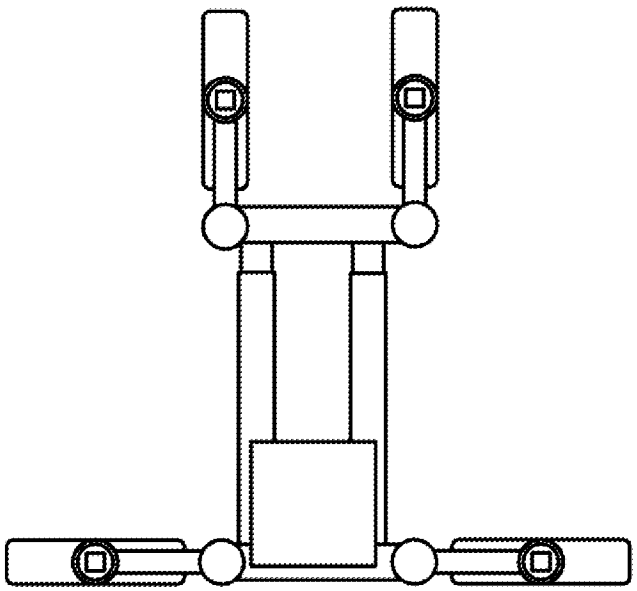

Referring now to FIG. 4, a method 400 of selectively reconfiguring pivot arms and track sections of the paving machine from pave-to-transport is described, in accordance with one or more embodiments of the present disclosure. The method 400 may further be understood with reference to FIGS. 5A-5F. The embodiments and the enabling technologies described previously herein in the context of the paving machine 100 should be interpreted to extend to the method 400. For example, the method 400 may be implemented by the processor 110 of the paving machine 100. In this regard, the processor 110 may be considered to include pivot arm repositioning software which automatically reconfigures the pivot arm for direction of travel changes. It is further recognized, however, that the method 400 is not limited to the paving machine 100. In some instances, the frame of the paving machine 100 may be kept substantially still while implementing the method 400.

In a step 410, a command is received to reconfigure adjacent pivot arms (e.g., pivot arm 106*a* and pivot arm 106*b*) from a transport orientation to a paving orientation. The command may be received by a user input. The command may also be received at an end of a paving operation. By reconfiguring the pivot arms from the paving orientation to the transport orientation, a machine direction of travel may be changed from paving to transport.

In a step 420, a priority is determined between the adjacent pivot arms based on the angular positions of the adjacent pivot arms. In this regard, the current angular positions may be received (i.e., received from the angle sensor 134 for determining the relative angle of the pivot arm 106 relative to the frame 102). The priority may then be established. In some embodiments, the priority is based on the current angular position of the priority pivot arm being closer to the transport angle. In this regard, the priority pivot arm may be reconfigured to the transport orientation more rapidly than the non-priority pivot arm. Alternatively, the priority may be based on whichever pivot is further away from the desired angle. Although the step 420 is described as determining the priority based on the angular position, this is not intended as a limitation on the present disclosure. In this regard, the priority may be preset. For example, the leading pivot arm (or similarly the trailing pivot arm) may always have priority over the adjacent pivot arm such that the step 420 is not required. By way of another example, a user may input the priority.

In a step 430, track sections are rotated relative to their associated pivot arms. The track sections may be rotated until the track sections are perpendicular or substantially perpendicular to their associated pivot arms. Furthermore, the rotation may occur sequential or simultaneously. Advantageously, a reconfiguration time may be reduced where the rotation is performed simultaneously. By rotating the track section substantially perpendicular to the pivot arms, a track drive of the track sections may be engaged to assist in rotating the pivot arms. As may be understood, the track sections may be rotated relative to their associated pivot arms by any suitable means, such as providing power to the slew drive 116.

In a step 440, track sections and pivot arms are simultaneously engaged to rotate the priority and non-priority pivot arms. The priority pivot arm may be rotated from the current orientation (e.g., the paving orientation) to the transport orientation. The non-priority pivot arm may be rotated from the current orientation (e.g., the paving orientation) to an intermediary orientation. The intermediary orientation may be between the paving orientation and the transport orientation in which the non-priority track section does not or will not interfere with the priority track section. The intermediary orientation may be determined based on the no-go zone 300. For example, the non-priority pivot arm may include a steering limit based on the position and orientation of the priority pivot arm which is dynamically adjusted as the priority pivot arm is reconfigured. As may be understood, the track sections may be engaged by any suitable means, such as by providing power to the track drive 120. Similarly, the pivot arms may be engaged by any suitable means, such as by providing power to the slew drive 118.

In a step 450, the priority track section is rotated relative to the priority pivot arm until the priority track section is substantially parallel to a transport direction. Where the angle of the pivot arm is at a substantially ninety-degree angle relative to the frame in the transport orientation, the track section may also be substantially parallel with the first pivot arm. However, where the angle of the pivot arm is at less than ninety-degrees relative to the frame in the transport orientation, the track section may not be parallel with the pivot arm when parallel to the transport direction.

In a step 460, the non-priority track section and the non-priority pivot arm are reengaged to rotate the pivot arm from the intermediary orientation to the transport orientation.

In a step 470, the non-priority track section is rotated relative to the pivot arm until the non-priority track section is substantially parallel to the transport direction. The remaining pivot arms may then be reconfigured (not depicted).

Although the method 400 is described as selectively reconfiguring pivot arms and track sections of the paving machine from pave-to-transport, this is not intended as a limitation of the present disclosure. In this regard, various steps of the method 400 may be performed to selectively reconfigure the pivot arms and the track section from transport-to-pave.

Furthermore, although FIGS. 5A-5F depict adjacent pivot arms being reconfigured for a side, this is not intended as a limitation on the present disclosure. In this regard, the method 400 may be simultaneously performed for each side of the paving machine. However, performing the method for one side at a time may provide support to the paving machine, effectively braking the paving machine from inadvertent movement.

Figure 6A:
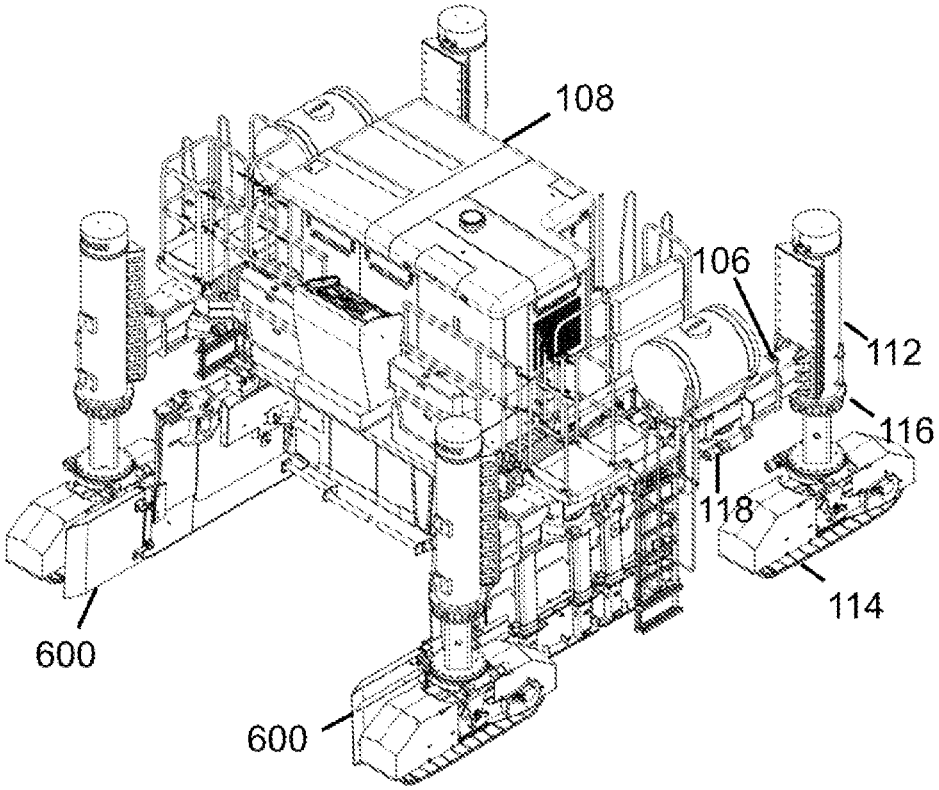
FIG. 6A depicts a perspective view of a paving machine with a slipform mold, in accordance with one or more embodiments of the present disclosure.
Figure 6B:
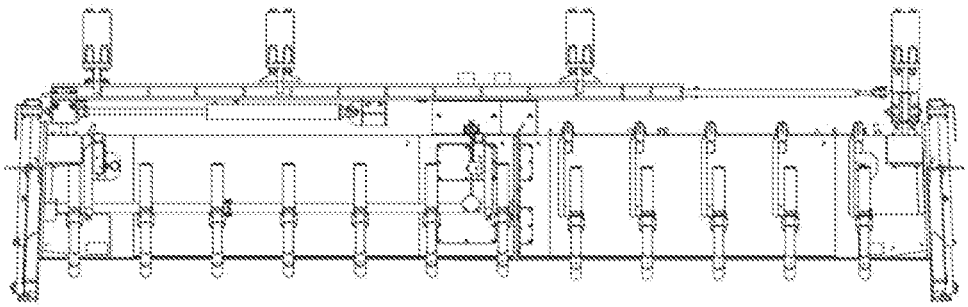
FIGS. 6B-6C depict a slipform mold with an adjustable-width, in accordance with one or more embodiments of the present disclosure.
Figure 6C:
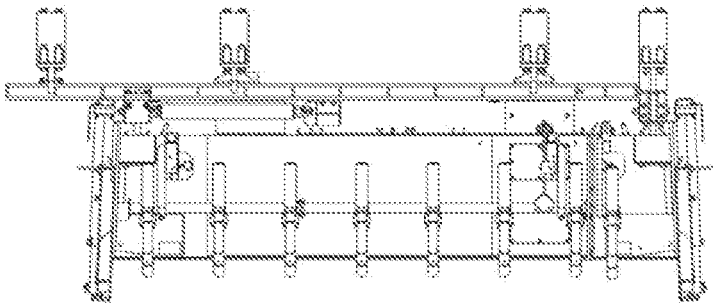

Referring now to FIGS. 6A-6D, a slipform mold 600 of the paving machine 100 is described, in accordance with one or more embodiments of the present disclosure. In embodiments, the slipform mold 600 is a fixed width mold. In embodiments, the slipform mold 600 has an adjustable width. For example, the slipform mold 600 may be a variable width paving mold 600*a*, such as a Gomaco V2 variable width paving mold, as depicted in FIGS. 6B-6C. The variable width paving mold may provide the paving machine 100 with an ability to form tapered slabs on-the-go by a paving width change. In this regard, the paving mold 600 may include a hydraulically telescoping rolling frame with dual rollers.

The leg assemblies may or may not interfere with the slipform mold 600 depending upon a position of the slipform mold 600. The position of the slipform mold 600 may be variable due to the variable width or based on an adjustable mounting location of the slipform mold 600 on the frame. For example, the slipform mold 600 may be mounted in a number of locations along the frame, to accommodate width changes and the like.

In some embodiments, the paving machine 100 includes the mold sensor 140. The mold sensor 140 may provide information associated with the slipform mold 600, such as a current width or a position relative to the frame 102. The mold sensor 140 may include a number of suitable sensors. For example, the mold sensor 140 may include an encoder coupled to a chain drive of the paving mold 600. By way of another example, the mold sensor 140 may include a linear transducer coupled to a hydraulic cylinder of the slipform mold 600. By way of another example, the mold sensor 140 may also include a sensor unit for determining an offset of the slipform mold 600 from the frame 102. For example, the sensor unit may include, but is not limited to, a laser, a camera, a radar sensor, a light detection and ranging (LiDAR) sensor, or another proximity sensor.

Although the no-go zone 300 has been described in pave-to-transport or transport-to-pave contexts, this is not intended as a limitation on the present disclosure. No-go zones may also be determined for various other configurations of the paving machine 100. For example, the no-go zone 300 may be determined for the leg assemblies during paving operations to prevent interference with one or more accessories, such as, but not limited to, the mold 600, a conveyor, a trimmer, or the like.

Figure 6D:
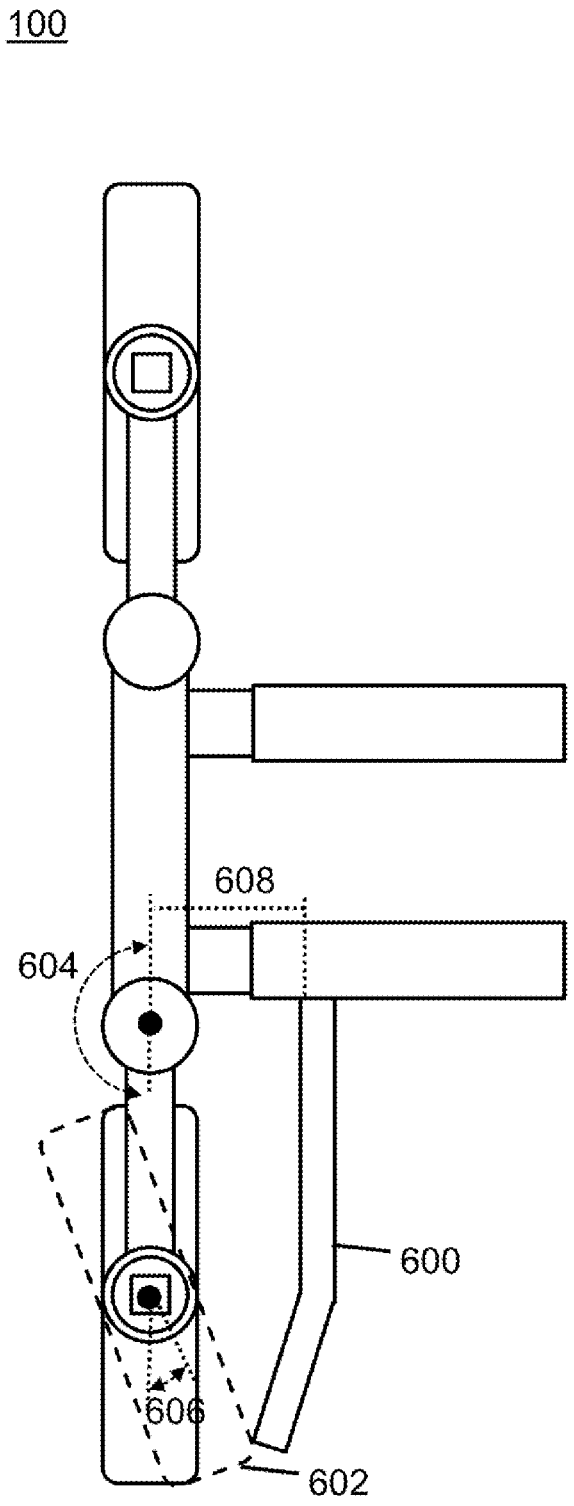
FIGS. 6D-6E depicts a simplified top view of a no-go zone of a paving machine, in accordance with one or more embodiments of the present disclosure.
Figure 6E:
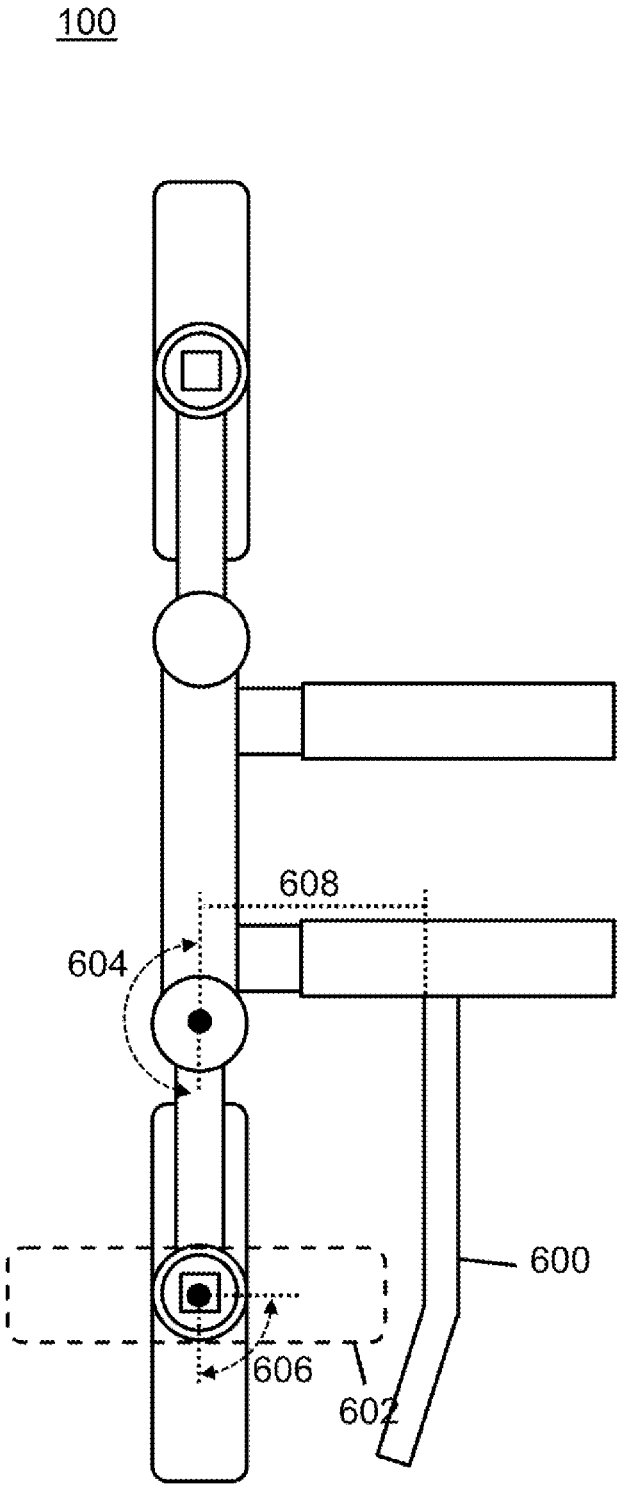

Referring now to FIG. 6D-6E, a no-go zone 602 may indicate one or more components of the paving machine 100 will interfere with the mold 600. The steering limit associated with the no-go zone 602 may be an angle 604 of the pivot arm 106 together with an angle 606 of the track section 114 (e.g., the slew drive 116) at which the track section 114 will interfere with the slipform mold 600. The processor 110 may selectively control the pivot arm 106, the leg assembly 112, and the track section 114 according to a steering limit for the angle 604 and/or the angle 606 to avoid the no-go zone 602 during paving operations and/or when reconfiguring the paving machine 100 between transport and pave. The processor 110 may use the position information when automatically adjusting the pivot arm 106, the leg assembly 112, or the track section 114 to prevent from running into the mold 600. The pivot arm 106, the leg assembly 112, or the track section 114 may be prevented from running into the mold 600 by steering the pivot arm 106 and the track section 114 within the steering limit.

The steering limits and the no-go zone 602 may be determined based on the dimensions of the pivot arm 106, the leg assembly 112, the track section 114, the mold 600, and a distance 608. The distance 608 may be based on a position of the mold 600 relative to a reference location on the paving machine 100, such as from the mount of the mold 600 to the end car flange, or other similar dimension (e.g., a current width of the mold 600, a mounting location of the mold 600, etc.). For example, the steering limit for the angle 606 of the lower track section 114 in FIG. 6D may be relatively more constrained than in FIG. 6E, due to the distance 608. In this regard, the track section 114 of FIG. 6D may initially provide reduced assistance when reconfiguring from pave-to-transport, as compared to 90-degree helper angle of the track section 114 of FIG. 6E. The steering limit for the angle 606 may then be opened up as the angle 604 of the pivot arm 106 is moved towards the transport orientation.

In some instances, the distance 608 is preset by a user, based on the location where the user has coupled the mold 600 to the frame 102. For example, a user may measure and input the distance 608 at which the mold 600 is attached to the frame 102 relative to the end car. In some instances, the distance 608 is determined by a sensor, such as a lidar or a radar.

The no-go zone 602 and the angle 604 and the angle 606 may further be dynamically updated where the width of the mold 600 is adjusted during paving. The mold sensor 140 may determine the width adjustments. The steering limit for the pivot arm 104 and the track section 114 may then be dynamically adjusted based on distance 608 and the current width of the mold 600 along with known dimensional information for the pivot arm 106, the leg assembly 112, and the track section 114.

Figure 6F:
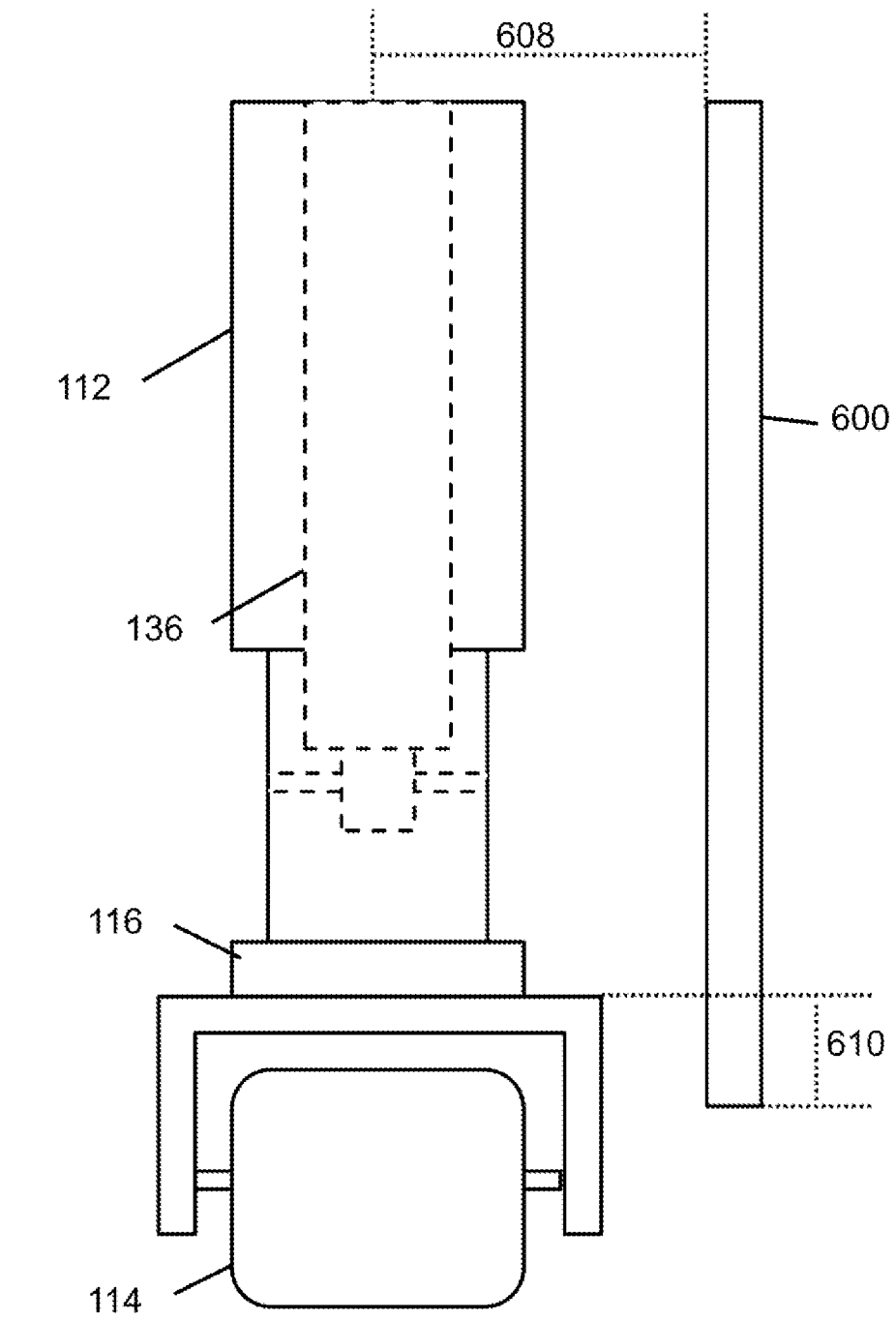
FIGS. 6F-6H depict a simplified front view of a paving machine, in accordance with one or more embodiments of the present disclosure.
Figure 6G:
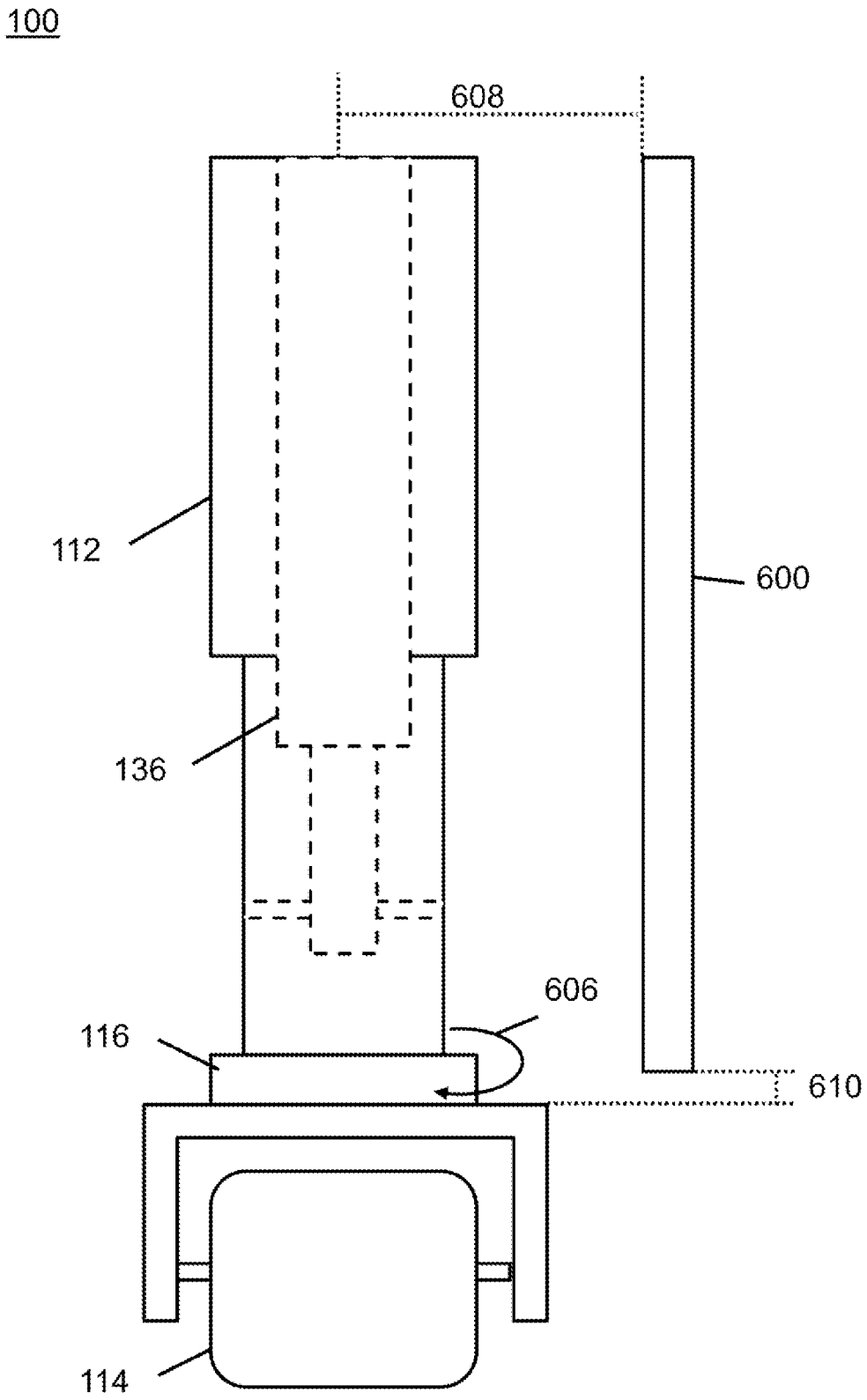
Figure 6H:
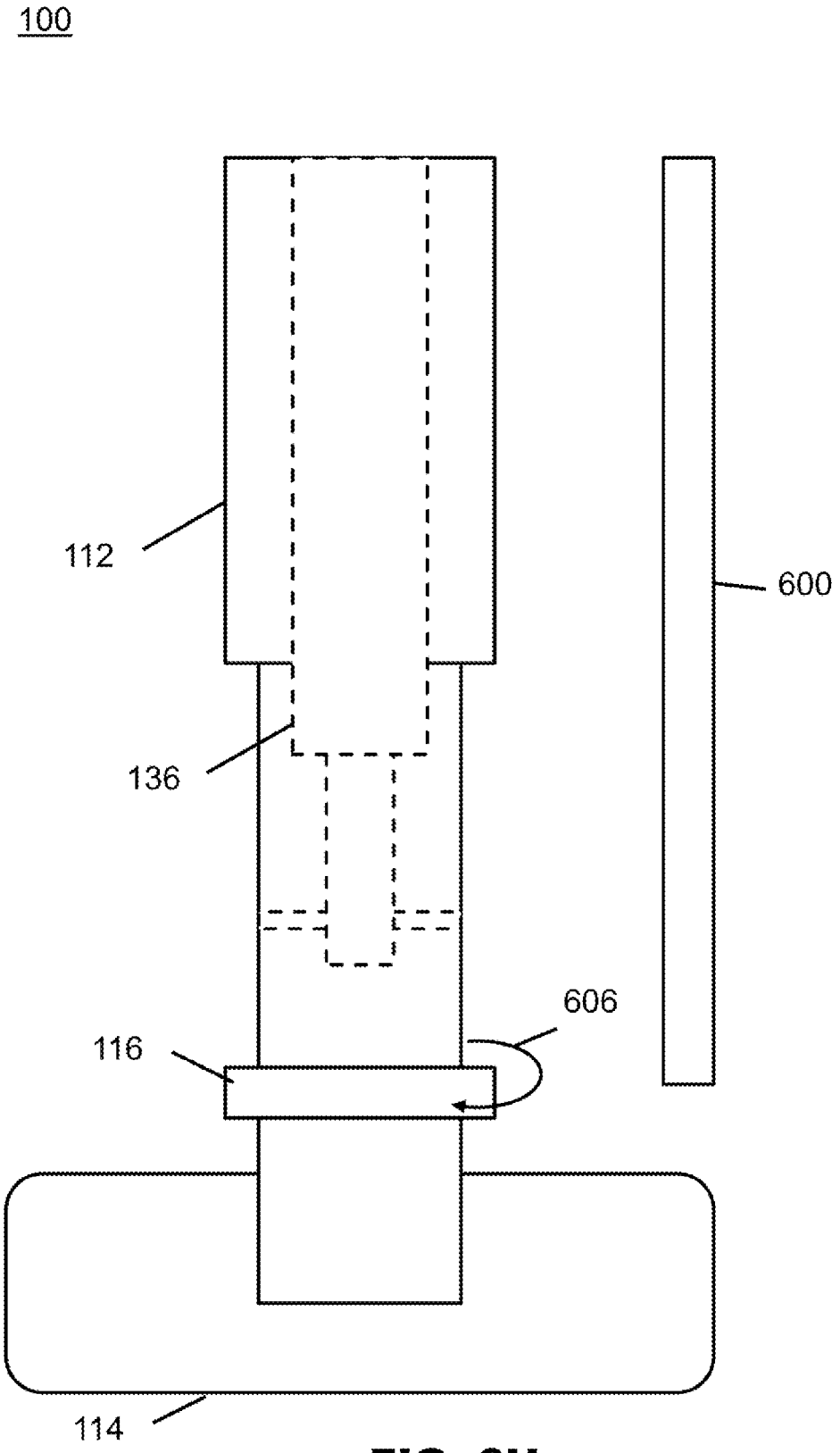

Referring now to FIGS. 6F-6H, the no-go zone 602 is described in three dimensional contexts. The hydraulic cylinder 136 is depicted in dashed lines for clarity purposes. Furthermore, various shrouds of the track section 114 are not depicted for clarity purposes. Furthermore, although the paving machine 100 is depicted as including the slew drive 116 between the track section 114 and a lower guide tube of the leg assembly 112, this is not intended to be limiting.

Where the no-go zone 602 is determined in three dimensional contexts, the processor 110 may determine the slipform mold 600 is at a distance 610 relative to the track section 114, such that the track section 114 may or may not be rotated below the slipform mold 600. Such determination may be based on information received from the linear transducer 138 of the hydraulic cylinder 136 of the leg assembly 112. As depicted in FIG. 6F, the distance 610 may be such that the lower track section 114 may interfere with the mold 600, based upon the angle 604, the angle 606, and/or the distance 608 (see further FIG. 6D above). As depicted in FIG. 6G, the hydraulic cylinder 136 has been extended to raise the mold 600 (by way of the frame 102) above the track section 114. As depicted in FIG. 6H, the angular orientation of the track section 114 may then be controlled by the slew drive 116 for allowing the track section 114 to travel under the mold 600 without interfering with the mold 600. This may be advantageous in allowing the paving machine 100 to be more rapidly reconfigured by opening up the steering limit on the angle 606. It is noted however, that the descriptions in regards to FIGS. 6F-6H is not intended to be limiting. In this regard, the paving machine 100 may be controlled to avoid the mold 600 without the use of the linear transducer 138 and without determining a no-go zone in three dimensions. Thus, the steering limit for the angle 606 may be determined based on the distance 610 as well as the distance 608 and the angle 604.

It is further contemplated that the distance 610 may be determined by one or more sensors (not depicted) which detect a relative distance to a ground surface from the track section 114 or another component of the paving machine 100. For example, the sensors may be similar to one or more sensors described in U.S. Pat. No. 11,077,732 by Peter Busley, assigned to Wirtgen America Inc., titled "AUTOMOTIVE CONSTRUCTION MACHINE, AS WELL AS LIFTING COLUMN FOR A CONSTRUCTION MACHINE" which is incorporated herein by reference in the entirety.

Although much of the present disclosure has been directed to dynamically determining the steering limits for the pivot arm and the track section to avoid running into adjacent pivot arms or the slipform mold, this is not intended as a limitation of the present disclosure. It is contemplated that the dynamic steer limits may be applicable to control the steering limits for the pivot arm and the track section to avoid running into any number of components of the paving machine 100, such as, but not limited to, a bar inserter, drag pan, a ladder, and the like. The steering limits for the pivot arm and the track section may be dynamically controlled depending upon whether the various components are coupled to the paving machine 100.

Figure 7A:
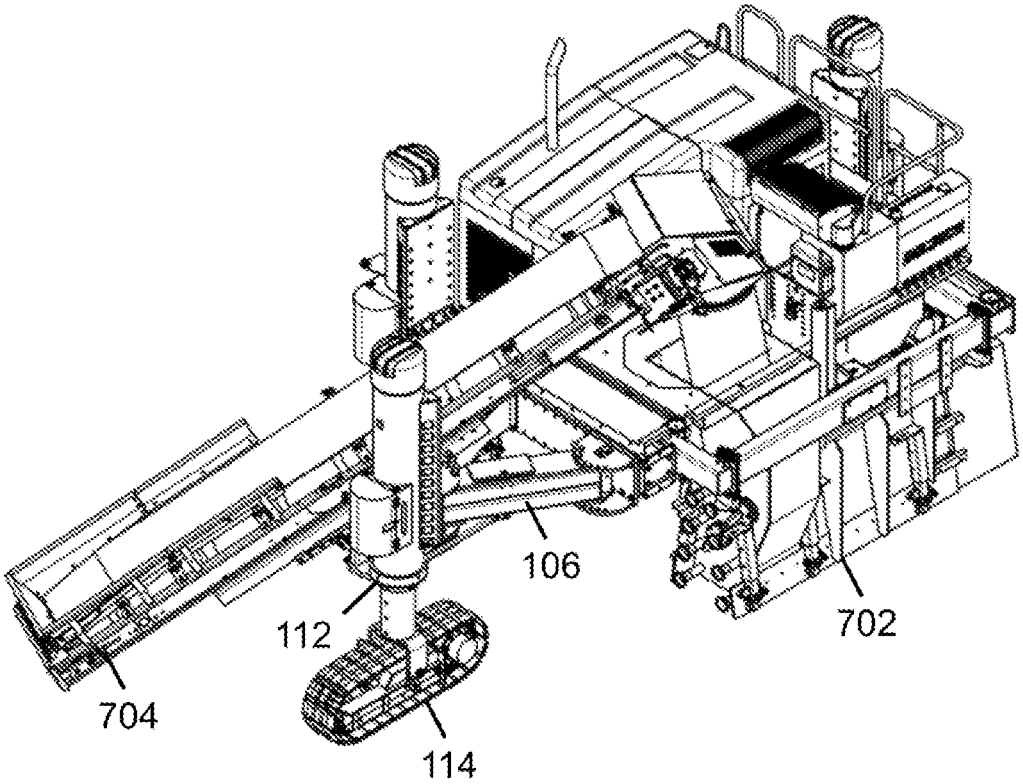
FIG. 7A depicts a perspective view of a paving machine including a conveyor and a barrier attachment, in accordance with one or more embodiments of the present disclosure.
Figure 7B:
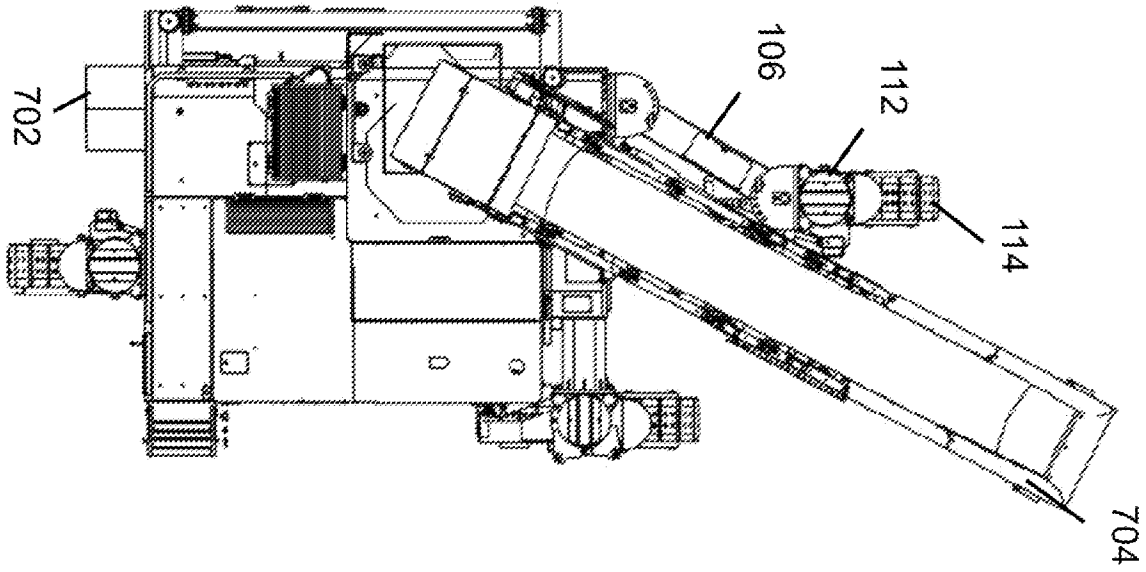
FIG. 7B depicts a top view of a paving machine including a conveyor and a barrier attachment, in accordance with one or more embodiments of the present disclosure.
Figure 7C:
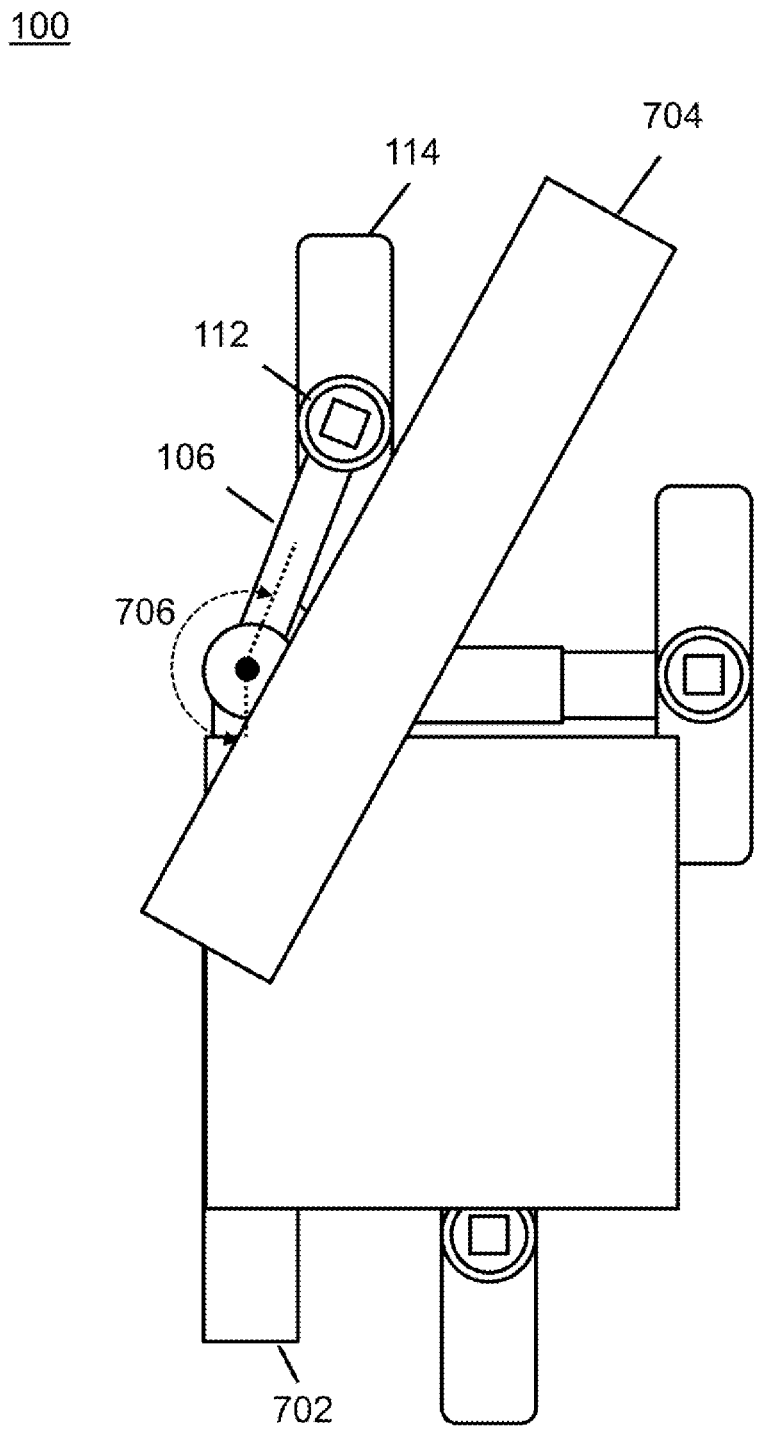
FIGS. 7C-7D depicts a simplified top view of a paving machine including a conveyor and a barrier attachment, in accordance with one or more embodiments of the present disclosure.
Figure 7D:
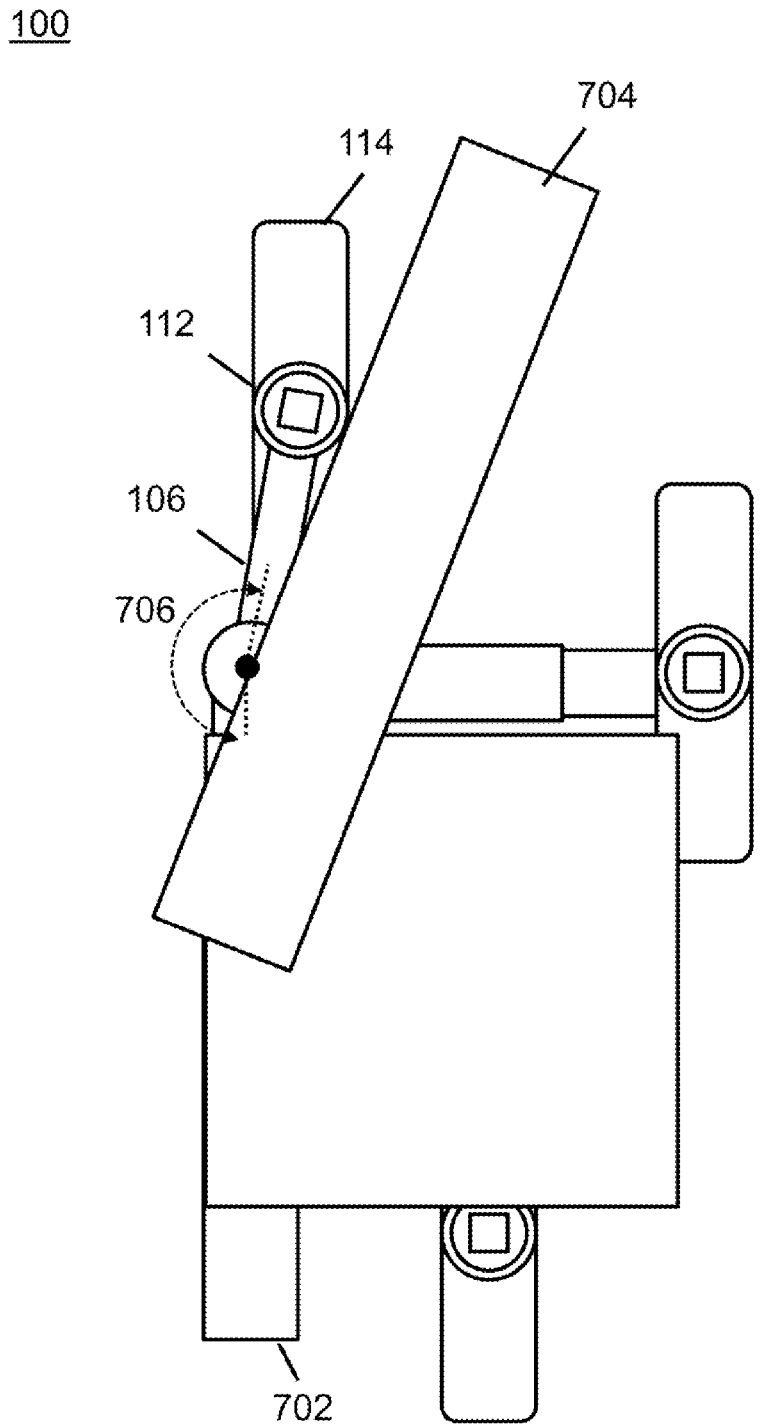

Referring now to FIGS. 7A-7B, although much of the present disclosure has been depicted for a four-track configuration of the paving machine 100, this is not intended as a limitation of the present disclosure. It is further contemplated that the paving machine 100 may be a three-track paving machine which is configured to dynamically control the steering limits for the pivot arm 106 and the track section 114 to avoid running into any number of components. As depicted, the paving machine 100 may be a three-track paver including a barrier attachment 702 and a conveyor 704. The conveyor 704 may convey concrete material to the barrier attachment 702 for forming a concrete barrier. The paving machine 100 may also include the leg assembly 112 and the track section 114. In embodiments, a steering limit for the pivot arm 106, the leg assembly 112, and/or the track section 114 are dynamically controlled based on the location of the conveyor 704, such as to prevent from interfering with the conveyor 704. The conveyor 704 may be configured to slide or tilt. The slide or tilt of the conveyor 704 may cause the processor 110 to decrease the steering limits for the pivot arm 106 and the track section 114 to prevent interference with the conveyor 704. As depicted in FIG. 7C, the pivot arm 106 may include an angle 706 at which the leg assembly 112 may interfere with the conveyor 704. The processors 110 may control the pivot arm 106 within the angle 706 by setting a steering limit based on a slide or tilt of the conveyor. As further depicted in FIG. 7D, a leading edge of the conveyor 704 has been repositioned closer towards the barrier attachment 702. The angle 706 has been readjusted to prevent the leg assembly 112 from interfering with the conveyor 704.

It is further contemplated that the pivot arm 106, the leg assembly 112, and the track section 114 may be dynamically controlled to avoid any number of three-track or four-track paving accessories, such as, but not limited to, trimmers, ladders, side bar inserters, and the like. Additionally, the paving machine 100 may generally include any number of components which may be actuated and selectively controlled by the methods described above to prevent interference with other components of the paving machine 100.

Figure 8:
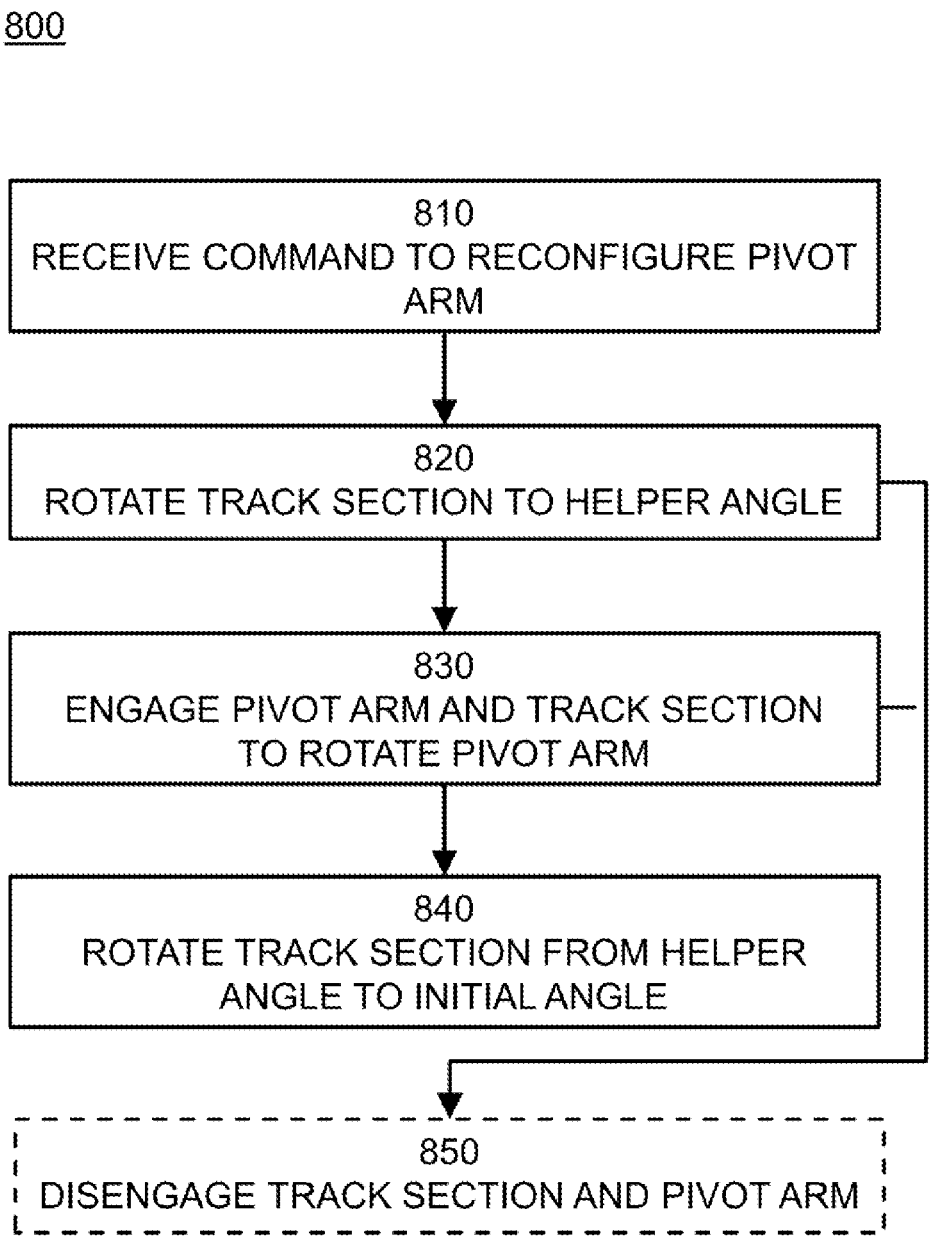
FIG. 8 depicts a flow diagram of a method of pivot arm repositioning, in accordance with one or more embodiments of the present disclosure.

Referring now to FIG. 8, a method 800 is described, in accordance with one or more embodiments of the present disclosure. The embodiments and the enabling technologies described previously herein in the context of the paving machine 100 should be interpreted to extend to the method 800. For example, the method 800 may be implemented by the processor 110 of the paving machine 100. In this regard, the processor 110 may be considered to include pivot arm repositioning software which automatically reconfigures the pivot arm for direction of travel changes. It is further recognized, however, that the method 800 is not limited to the paving machine 100. In some instances, the frame of the paving machine 100 may be kept substantially still while implementing the method 800. For example, a display of the paving machine 100 may be navigated to an automatic pivot arm repositioning user interface when the frame is stationary.

In a step 810, an automatic pivot function may be enabled. The automatic pivot function may include receiving a desired angle for the track section and the pivot arm. A user interface of the paving machine may include angular position inputs for each of the pivot arms and the track sections. A user may press a button on the display and then input the target angular position. In embodiments, one pivot arm is allowed to be moved for each side at a given time. It is further contemplated that two pivot arms may be allowed to move for each side, such as by a process similar to the method 400.

In embodiments, multiple commands to reposition the pivot arms and/or the crawler tracks may be input. For example, a first command may be to change the angle of the left front pivot arm and a second command may be to change the angle of the right front pivot arm. The processors may control the command in order according to the queue.

In a step 820, the processors may rotate the track section to a helper angle in response to receiving the command to move the pivot arms. For example, the track section may be rotated to be orthogonal or otherwise set at a ninety-degree angle relative to the pivot arm. By way of another example, the helper angle may be limited by one or more steering limits, such as a steering limit determined by the processors 110 based on the various no-go zones described above. The processors may cause a slew drive to rotate the track section from the initial angle to the helper angle.

In a step 830, the track section and the pivot arms are engaged once the track section is set to the desired helper angle. The pivot arm and the track section may then be engaged until the pivot arm is at the desired position.

In a step 840, the track section may then be rotated back from the helper angle to an initial angle once the pivot arm has reached the desired angle.

In embodiments, the processors 110 may ignore one or more steer limits which are manually input by an operator while performing the method 800 while moving the track section and the pivot arms. In embodiments, the pivot arms and the track section are moved without regard to another component of the paving machine, such as the slipform mold 600, although this is not intended to be limiting. In embodiments, the pivot arms and the track section are moved while remaining within steering limits determined by the processors. The steering limits may be placed by the processors by any of the techniques described previously herein. The steering limit may limit the helper angle to which the track section may be rotated. For example, the helper angle may be limited based on the width of the mold 600. The steering limit may also limit the angle of the pivot arm.

In an optional step 850, the processors may disable the pivot arm and the track section prior to reaching the target angle. The pivot arm and the track section may be disabled in response to the processors determining that there will be interference with another pivot arm or track section (e.g., based on a steering limit), the pivot movement has exceeded a maximum pressure (e.g., based on pressure readings from a pressure transducer), a sensor has failed, an emergency stop has been pressed, and/or the paving machine has been placed into a run-standby mode.

Figure 9A:
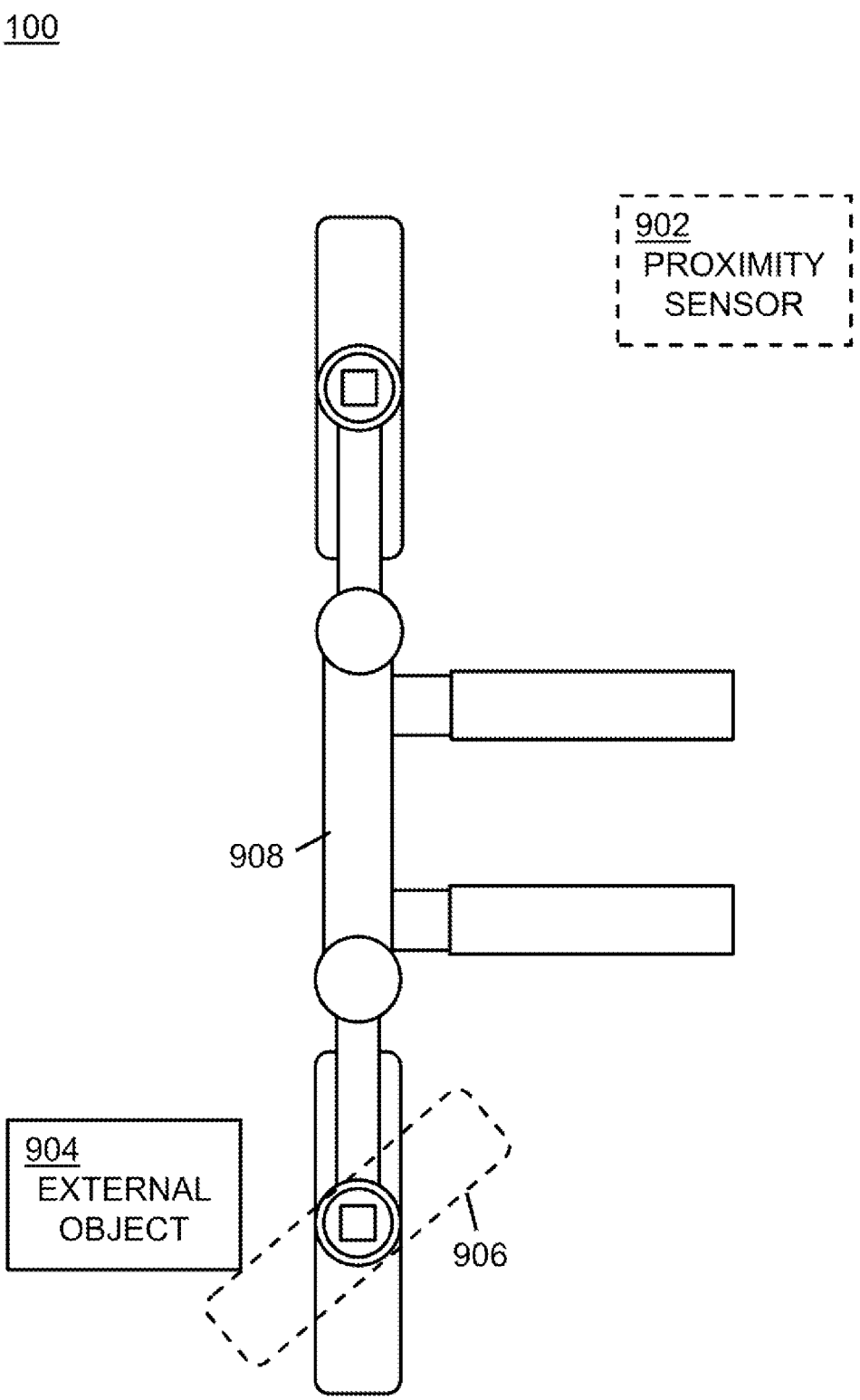
FIG. 9A depicts a simplified top view of a no-go zone of a paving machine, in accordance with one or more embodiments of the present disclosure.
Figure 9B:
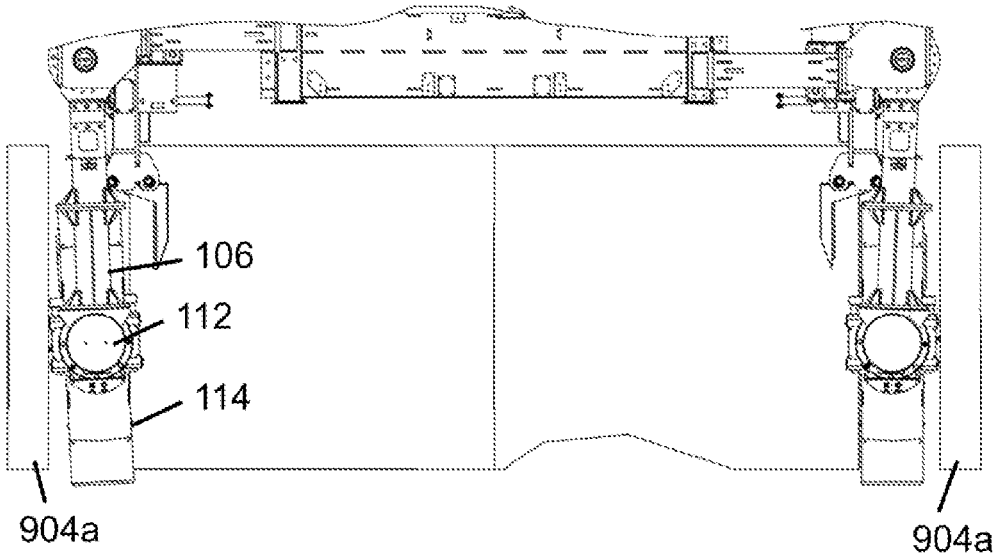
FIG. 9B depicts a top view of a paving machine with a track section disposed adjacent to a barrier, in accordance with one or more embodiments of the present disclosure.
Figure 9C:
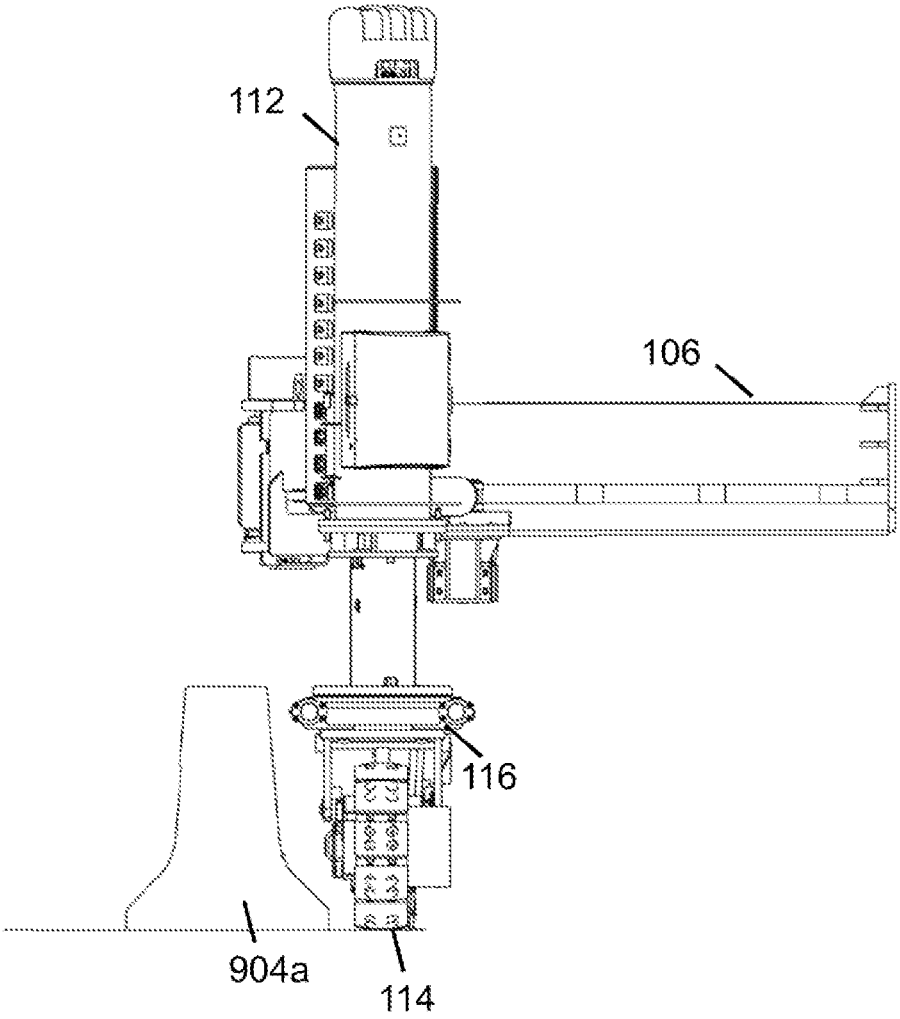
FIG. 9C depicts a rear view of a paving machine with a track section disposed adjacent to a barrier, in accordance with one or more embodiments of the present disclosure.

Referring now to FIGS. 9A-9C, the paving machine 100 is further described. Although much of the present disclosure has been directed to automatically controlling various components of the paving machine 100 according to steering limits to prevent from running into another component of the paving machine 100, this is not intended as a limitation of the present disclosure. In embodiments, the various components of the paving machine 100 are automatically controlled to prevent the paving machine 100 from running into an external object 904. As may be understood, the external object 904 may generally include any object external to the paving machine 100. As depicted in FIGS. 9B-9C, an external object 904*a* may be a barrier wall, although this is not intended to be limiting. The processors 110 may receive the data from the proximity sensor 902 and identify if the pivot arm 106, the leg assembly 112, or the track section 114 is getting too close to the external object 904 based on the distance data. Distance data from the proximity sensor 902 may be utilized to determine a no-go zone 906 and an associated steering limit for the pivot arm 104 and/or the track section 114. The pivot arm 104 and the track section 114 may then be controlled according to the steering limits to avoid the no-go zone 906 and additionally avoid running into the external object 904.

The paving machine 100 may include one or more sensors for determining a position of the paving machine 100 relative to the external object 904. The proximity sensor 902 may generate distance data indicative of the distance from the external object 904 to the proximity sensor 902. The sensor may include a proximity sensor 902, such as a metal-to-metal sensor, a radar, a LiDAR, a range detector, a camera, and the like. For example, the proximity sensor 902 may include a camera. The processors 110 may receive images from the camera and estimate a distance of the external object 904 relative to the paving machine 100 by executing one or more depth detection algorithms on the images from the camera. The steering limits for the pivot arm 106 and the track section 114 may be controlled based on the estimated distance. In this regard, the processors 110 may compute the no-go zone by any of the previously described methods and then set the steering limits for an angle of the track section and for an angle of the pivot arm based on the no-go zone 906.

The proximity sensor 902 may be oriented to capture the distance data to the external object. For example, the proximity sensor 902 may be coupled to one or more of the frame 102, the pivot arm 106, the leg assembly 112, or the track section 114.

In embodiments, the proximity sensor 902 may be mounted to an end-frame 908 of the frame 102. The end-frame 908 may also be referred to as an end car. The paving machine may include two of the end-frames which are disposed on each side of the paving machine. Optionally, a distance of the end-frames may be adjusted (e.g., by a width adjustable frame). The distance of the end-frame 908 to the external object may be used for no-go zone computations regarding the external object. In some instances, data from the proximity sensor 902 may be used to determine a skew of the end-frame relative to the external object. For example, the external object 904 may be a barrier wall (e.g., a highway barrier, a jersey barrier, k-rail, etc.) found along a length of highway or another roadway. The paving machine may be moving away, be parallel with, or moving towards the barrier depending upon the angle of the track section 114 relative to the barrier. The proximity sensor may capture data of the barrier relative to the end-frame 908. The data may include multiple positions of the barrier, which may be used by the processor to generate a three-dimensional reference of the barrier relative to the end-frame. The processor may determine the barrier is set at an angle (i.e., skewed) to the track section 114. The processor may determine the angle based on the skew relative to the end frame 908 and the calculated position and orientation of the track section 114. One or more components of the paving machine (e.g., the track section 114, the slew drive 116, the pivot arm 106, or the slew drive 118) may be controlled based on the angle to cause the track section 114 to become parallel to the barrier. In this regard, the paving machine may follow the barrier to provide a paved surface close to the existing barrier without running into the barrier, which may be beneficial when a highway including the barriers is being repaved.

In embodiments, the proximity sensor 902 may mounted at one or more ends of track fenders 1004 (see FIG. 10 for example) of the track section 114. For example, the proximity sensor(s) may be placed at a front end, a left side, a rear end, and/or a right side of the track fenders. Data from the proximity sensor(s) may then be used to determine if the track fenders are likely to collide with the external object during steering and/or pivoting movement. The proximity data may trigger one or more alerts when a distance to the external object falls below a threshold. When the alert is triggered, the processors may dynamically determine the position and orientation of the external object using a known position and orientation of the crawler track and the pivot arm together with the data from the proximity sensor 902. The processors may then control the pivot arm and the track section based on the distance data.

In some instances, the proximity sensor 902 may have a reduced ability to detect the proximity when covered in particles such as dirt, dust, or concrete. It is contemplated that the sensor may be mounted to avoid the particles. For example, the sensor may be mounted high enough on the paving machine to avoid the particles with a bird's eye view pointed downwards of the external objects 904.

A display of the paving machine 100 is described, in accordance with one or more embodiments of the present disclosure. In embodiments, images from multiple of the cameras used for proximity sensing may be patched together to provide a surround view (e.g., a 360 degree or less view) surrounding the paving machine. The surround view may include an overhead, top, or birds eye view. Images from the cameras may be combined with the kinematic model of the paving machine to generate the surround view. The surround view may then be provided to an operator display of the paving machine. The surround view may be beneficial in allowing the operator to visually see what is surrounding the paving machine without leaving the controls. For example, a camera may be provided for each pivot arm 106, leg assembly 112, and/or track section 114. The images from each of the cameras may be patched together to generate the surround view.

One difficulty with patching together the images in the context of paving machines is that a distance between the images may be offset, depending upon a configuration of the machine. The paving machine may experience dimensional changes when a width of the paving machine is adjusted causing the images to be offset. It is contemplated that the processors 110 may account for the width changes when patching the images together to generate the surround view. For example, a user may input a frame width or the frame width may be determined by one or more sensors. The processors 110 may receive the frame width and increase the width of the paving machine displayed. Similarly, the angle of the pivot arm and the track section may change. It is further contemplated that the processors 110 may account for the angle of the pivot arm and the track section when generating the surround view. For example, the pivot arm, the leg assembly, or the track section may be angularly repositioned, causing a distance between the images to be offset. The processors 110 may receive angular position data (e.g., from the angle sensor 128, the angle sensor 134, etc.), and account for the angular position of the pivot arm 106, the leg assembly 112, or the track section 114 when patching together the images. The processor may thus generate the kinematic model and similarly the graphical image based on the frame width data and the angular position data.

Figure 10:
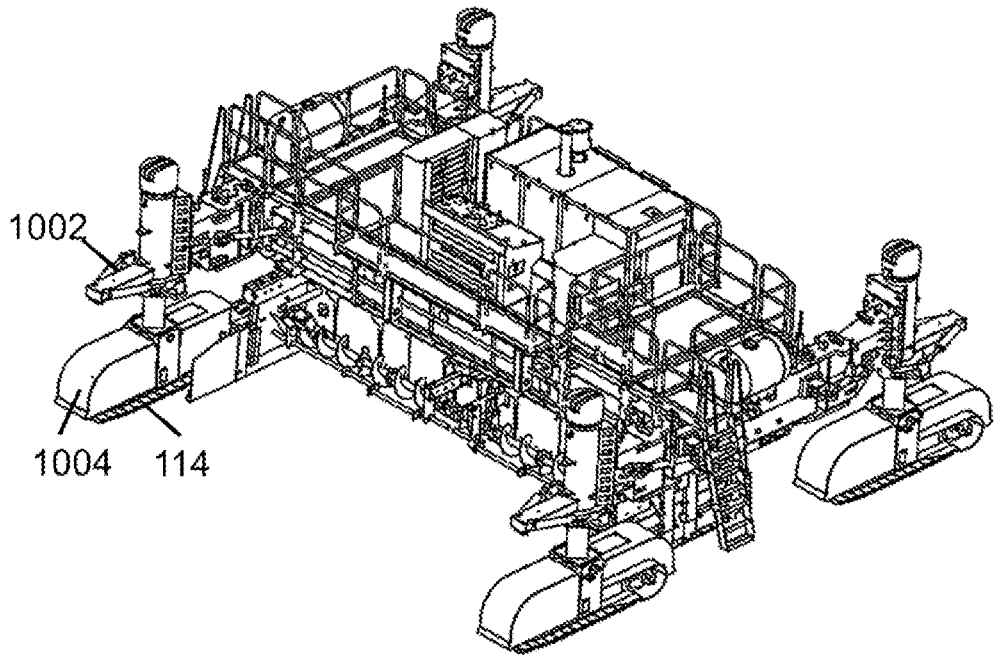
FIG. 10 depicts a perspective view of a paving machine including a hydraulic steering cylinder, in accordance with one or more embodiments of the present disclosure.

Referring now to FIG. 10, the paving machine 100 may include one or more hydraulic steering cylinders 1002. The hydraulic steering cylinder 1002 may control the steering angle 204 of the track section. The functionality of the slew drive 116 may thus be replaced by the hydraulic steering cylinder 1002. In this regard, the hydraulic steering cylinder may be controlled according to any of the various no-go zones, kinematic models, proximity sensors, and the like, which are described with reference to the slew drive 116. However, controlling the steering angle of the track section 114 by the slew drive 116 may be advantageous given that the slew drive 116 may permit a greater range or rotation, as compared to the hydraulic steering cylinder 1002. For example, the hydraulic steering cylinder may use a steering angle less than the 90 degrees depicted in FIGS. 5B-5E when performing pave-to-transport reconfiguration. Similarly, the functionality of the slew drive 118 may be replaced by a hydraulic cylinder, a turnbuckle, or another actuator.

Referring generally again to FIGS. 1A-10.

Although the paving machine 100 is described as being reconfigured from pave-to-transport prior to being loaded on a trailer, this is not intended as a limitation on the present disclosure. In some embodiments, the track sections 114 of the paving machine 100 may be loaded onto a trailer by removing a load from a track section 114, raising the track section 114 higher than the trailer, rotating the pivot arm 106 and track section 114 above the trailer, and lowering the track section 114 onto the trailer. The processor 110 may determine there is no weight on the track section, such that the associated pivot arm is freely moving. Where there is no weight on the track section, a track assistance may not be needed.

In the case of a control algorithm, one or more program instructions or methods may be configured to operate via proportional control, feedback control, feedforward control, integral control, proportional-derivative (PD) control, proportional-integral (PI) control, proportional-integral-derivative (PID) control, or the like.

Although the angle of the pivot arm 106 relative to the frame 102 or the angle of the track section 114 relative to 106 is described as being controlled by one or more slew drives, this is not intended as a limitation of the present disclosure. In some embodiments, one or more of the pivot arm 106 relative to the frame 102 or the steering angle of the track section 114 may be controlled by a planetary drive (not depicted). For example, the planetary drive may include a motor. The planetary drive may include a planetary gearset driven by such motor. By engaging the planetary gearset, the planetary drive may control an angular position of the pivot arm 106 or the steering angle of the track section. In some embodiments, the motor of the planetary drive is selectively controlled based on one or more sensors. For example, a rotary sensor may detect rotations of the motor. By determining the rotations of the motor, a corresponding angular position of the pivot arm 106 or the steering angle of the track section may be computed (i.e., based on the associated gear ratio of the planetary drive). By way of another example, the sensor may include a pressure sensor. The pressure sensor may determine a pressure of the hydraulic drive. Based on one or more of the pressure sensor or the rotary sensor, the planetary drive may be selectively controlled to adjust the pivot arm 106 or the steering angle of the track section.

Although one or more of the track drive 120, the motor 124, or the motor 130 is described as being powered by a hydraulic power, this is not intended as a limitation on the present disclosure. In this regard, one or more of the track drive 120, the motor 124, or the motor 130 may be powered by any power source, such as, but not limited to, an electric power source or a hydraulic power source. Similarly, one or more of the track drive 120, the motor 124, or the motor 130 may include any suitable sensor for measuring the electric power supplies, such as, but not limited to, current sensors, resistance sensors, or voltage sensors. Such sensors may be configured to sense the load of one or more of the slew drive 116, the slew drive 118, or the track drive 120.

As may be understood, the processor 110 may include any one or more processing elements known in the art. In this sense, the processor 110 may include any microprocessor-type device configured to execute software algorithms and/or instructions. For example, the processor 110 may consist of a mobile machine control computer, a desktop computer, mainframe computer system, workstation, parallel processor, or other computer system configured to execute a program configured to operate the paving machine 100, as described throughout the present disclosure. Similarly, the memory 111 may include any storage medium known in the art suitable for storing program instructions executable by the processor 110. For example, the memory 111 may include a non-transitory memory medium such as, but not limited to, a read-only memory (ROM), a random-access memory (RAM), a solid-state drive, and the like. It is further noted that memory 111 may be housed in a common controller housing with the processor 110. The processor 110 may be configured to receive the various information from the sensors by one or more controller area network buses.

For the purposes of the present disclosure, the term "processor" or "processing element" may be broadly defined to encompass any device having one or more processing or logic elements (e.g., one or more micro-processor devices, one or more application specific integrated circuit (ASIC) devices, one or more field programmable gate arrays (FPGAs), or one or more digital signal processors (DSPs)). In this sense, the one or more processors may include any device configured to execute algorithms and/or instructions (e.g., program instructions stored in memory).

Furthermore, the memory may include any storage medium known in the art suitable for storing program instructions executable by the associated one or more processors. For example, the memory medium may include a non-transitory memory medium. By way of another example, the memory medium may include, but is not limited to, a read-only memory (ROM), a random-access memory (RAM), a magnetic or optical memory device (e.g., disk), a solid-state drive and the like. It is further noted that memory medium may be housed in a common controller housing with the one or more processors. In one embodiment, the memory medium may be located remotely with respect to the physical location of the one or more processors.

All of the methods described herein may include storing results of one or more steps of the method embodiments in memory. The results may include any of the results described herein and may be stored in any manner known in the art. The memory may include any memory described herein or any other suitable storage medium known in the art. After the results have been stored, the results can be accessed in the memory and used by any of the method or system embodiments described herein, formatted for display to a user, used by another software module, method, or system, and the like. Furthermore, the results may be stored "permanently," "semi-permanently," temporarily," or for some period of time. For example, the memory may be random access memory (RAM), and the results may not necessarily persist indefinitely in the memory. It is further contemplated that each of the embodiments of the method described above may include any other step(s) of any other method(s) described herein. In addition, each of the embodiments of the method described above may be performed by any of the systems described herein.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "front," "back," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A paving machine comprising:

a frame including a slipform mold for moving in a first direction of travel for forming a material into shape;

a first end structure supporting at least a first portion of the frame, the first end structure including a first leg assembly, the first end structure further including a first track section with a first track drive for propelling the frame in the first direction, the first end structure including a first angle sensor;

a first pivot arm pivotably connecting the first leg assembly to the frame, the first pivot arm including a first slew drive and a second angle sensor;

a second end structure supporting at least a second portion of the frame, the second end structure including a second leg assembly, the second end structure further including a second track section with a second track drive for propelling the frame in the first direction, the second end structure including a including a third angle sensor;

a second pivot arm pivotably connecting the second leg assembly to the frame adjacent to the first pivot arm, the second pivot arm including a second slew drive and a fourth angle sensor;

a power supply connected to the first track drive, the first slew drive, the second track drive, and the second slew drive; and a processor configured, via executable code, to selectively engage the first track section and the first pivot arm to avoid the second end structure based on information received from the first angle sensor, the second angle sensor, the third angle sensor, and the fourth angle sensor, wherein the processor dynamically determines a steering limit for the first track section and the first pivot arm based on the information received from the first angle sensor, the second angle sensor, the third angle sensor, and the fourth angle sensor.

2. The paving machine of claim 1, wherein the first track section and the first pivot arm are selectively engaged while reconfiguring the first pivot arm and the second pivot arm from a paving orientation to a transport orientation; wherein the first pivot arm is simultaneously engaged with the second pivot arm for rotating both the first pivot arm and the second pivot arm from the transport orientation to the paving orientation.

3. The paving machine of claim 2, wherein while simultaneously engaging the first pivot arm and the second pivot arm, an angular velocity of the first pivot arm relative to the frame is less than an angular velocity of the second pivot arm relative to the frame.

4. The paving machine of claim 3, wherein the angular velocity of the first pivot arm relative to the frame is less than the angular velocity of the second pivot arm relative to the frame by supplying less power to the first slew drive than to the second slew drive and supplying less power to the first track drive than the second track drive.

5. The paving machine of claim 2, wherein the first pivot arm is rotated from the paving orientation to an intermediary orientation in which the first track section does not interfere with the second track section while the second pivot arm is rotated from the paving orientation to the transport orientation, the intermediary orientation disposed between the paving orientation and the transport orientation.

6. The paving machine of claim 1, wherein the processor is configured to receive a human input of a control signal to adjust the first track section and the first pivot arm beyond the steering limit, wherein the processor is configured to override the control signal and provide a notification via a display in response to receiving the human input.

7. The paving machine of claim 1, wherein the processor determines a no-go zone indicating a region where the first track section will interfere with the second track section; wherein the steering limit is determined based on the no-go zone.

8. The paving machine of claim 1, wherein the processor is configured to:

receive a command to change the first pivot arm and the second pivot arm from a paving orientation to a transport orientation, wherein the first pivot arm is adjacent to the second pivot arm on a side of the frame of the paving machine;

one of simultaneously or sequentially:

rotate the first track section relative to the first pivot arm until the first track section is substantially perpendicular to the first pivot arm; and rotate the second track section relative to the second pivot arm until the second track section is substantially perpendicular to the second pivot arm;

simultaneously:

engage the first track section and the first pivot arm to rotate the first pivot arm relative to the frame from the paving orientation to the transport orientation; and engage the second track section and the second pivot arm to rotate the second pivot arm relative to the frame from the paving orientation to an intermediary orientation between the paving orientation and the transport orientation in which the second track section does not interfere with the first track section;

rotate the first track section relative to the first pivot arm until the first track section is substantially parallel to a transport direction;

reengage the second track section and the second pivot arm to rotate the second pivot arm relative to the frame from the intermediary orientation to the transport orientation; and rotate the second track section relative to the second pivot arm until the second track section is substantially parallel to the transport direction.

9. The paving machine of claim 8, wherein the second pivot arm is rotated to the intermediary orientation based on a priority of the first pivot arm being higher than the second pivot arm.

10. The paving machine of claim 9, wherein the priority of the first pivot arm being higher than the second pivot arm is determined based on a current angular position of the first pivot arm and a current angular position of the second pivot arm.

11. The paving machine of claim 10, wherein the priority of the first pivot arm being higher than the second pivot arm is determined based on the current angular position of the first pivot arm being closer to the transport orientation than the current angular position of the second pivot arm.

12. The paving machine of claim 8, wherein the first track section is coupled to the first pivot arm by a first slew drive; wherein the first track section is rotated relative to the first pivot arm by supplying power from a power supply to the first slew drive; wherein the second track section is coupled to the second pivot arm by a second slew drive; wherein the second track section is rotated relative to the second pivot arm by supplying power from the power supply to the second slew drive.

13. The paving machine of claim 8, wherein the first track section is engaged by supplying power from a power supply to a track drive of the first track section, wherein the second track section is engaged by supplying power from the power supply to a track drive of the second track section.

14. The paving machine of claim 13, wherein the first pivot arm is rotatably coupled to the frame by a first slew drive; wherein the first pivot arm is engaged by supplying power from the power supply to the first slew drive; wherein the second pivot arm is rotatably coupled to the frame by a second slew drive; wherein the second pivot arm is engaged by supplying power from the power supply to the second slew drive.

15. The paving machine of claim 8, wherein the intermediary orientation is determined based on an expected position of the first track section when the first pivot arm is in the transport orientation, the first track section is substantially perpendicular to the first pivot arm, and the second track section is substantially perpendicular to the second pivot arm.

16. The paving machine of claim 15, wherein the expected position of the first track section is determined based on a length of the first pivot arm and a length of the first track section, and an expected angular position of the first pivot arm relative to the frame when the first pivot arm is in the transport orientation.

17. The paving machine of claim 16, wherein the intermediary orientation is further determined based on a length of the second pivot arm, a length of the second track section, and a distance between a rotatable connection of the first pivot arm and the frame and a rotatable connection of the second pivot arm and the frame.

18. A paving machine comprising:

a frame including a slipform mold for moving in a first direction of travel for forming a material into shape;

a first end structure supporting at least a portion of the frame, the first end structure including a first leg assembly, the first end structure further including a first track section with a first track drive for propelling the frame in the first direction, the first end structure further including a first slew drive and a first angle sensor;

a first pivot arm pivotably connecting the first end structure to a side of the frame, the first pivot arm including a second angle sensor;

a power supply connected to the first track drive and the first slew drive;

a processor configured, via executable code, to selectively engage the first track section and the first pivot arm to avoid the slipform mold based on information received from the first angle sensor and the second angle sensor; and a mold sensor configured to determine a current width of the slipform mold; wherein the first track section and the first pivot arm are selectively engaged based on the current width of the slipform mold and the information received from the first angle sensor and the second angle sensor, wherein the processor dynamically determines a steering limit for the first track section and the first pivot arm based on the current width of the slipform mold and the information received from the first angle sensor and the second angle sensor.

19. The paving machine of claim 18, wherein the mold sensor comprises at least one of an encoder coupled to a chain drive of the slipform mold, a linear transducer coupled to a hydraulic cylinder of the slipform mold, or a sensor unit configured to determine the current width based on an offset of the slipform mold from the frame.

20. The paving machine of claim 18, wherein the first leg assembly comprises a hydraulic cylinder configured to raise and lower the frame, the first pivot arm, and the slipform mold relative to the first track section, wherein the slipform mold is at a vertical distance relative to the first track section, wherein the processor also dynamically determines the steering limit for the first track section based on the vertical distance.

21. A paving machine comprising:

a frame including a slipform mold for moving in a first direction of travel for forming a material into shape;

a first end structure supporting at least a portion of the frame, the first end structure including a first leg assembly, the first end structure further including a first track section with a first track drive for propelling the frame in the first direction, the first end structure further including a first slew drive and a first angle sensor;

a first pivot arm pivotably connecting the first end structure to a side of the frame, the first pivot arm including a second angle sensor;

a power supply connected to the first track drive and the first slew drive;

a proximity sensor configured to capture a distance data of an external object relative to the paving machine; and a processor configured, via executable code, to selectively engage the first track section and the first pivot arm to avoid the external object based on the distance data received from the proximity sensor and angular position data received from the first angle sensor and the second angle sensor, wherein the processor is configured to determine the external object is skewed at an angle to the first track section and is configured to cause the first track section to become parallel to the external object in response to determining the external object is skewed at the angle to the first track section.

22. The paving machine of claim 21, wherein the proximity sensor is mounted to an end-frame of the frame.

23. The paving machine of claim 21, wherein the external object is a barrier wall.

24. The paving machine of claim 21, wherein the first track section includes a track fender; wherein the proximity sensor is coupled to the track fender.

25. The paving machine of claim 21, wherein the proximity sensor comprises a camera which captures one or more images of the external object; wherein the processor executes a depth detection algorithm to determine the distance data.

26. The paving machine of claim 25, further comprising a display; wherein the camera is one of a plurality of cameras of the paving machine; wherein the processor is configured to generate a birds-eye view of the paving machine on the display based on images from the plurality of cameras; wherein the processor is configured to graphically represent angular positions of the first pivot arm and the first track section on the birds-eye view based on the angular position data.

* * * * *